US011527346B2

(12) United States Patent
Matsumoto et al.

(10) Patent No.: US 11,527,346 B2
(45) Date of Patent: Dec. 13, 2022

(54) INDUCTOR

(71) Applicant: SHINKO ELECTRIC INDUSTRIES CO., LTD., Nagano (JP)

(72) Inventors: Takayuki Matsumoto, Nagano (JP); Tsukasa Nakanishi, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 411 days.

(21) Appl. No.: 16/533,009

(22) Filed: Aug. 6, 2019

(65) Prior Publication Data

US 2020/0051728 A1 Feb. 13, 2020

(30) Foreign Application Priority Data

Aug. 9, 2018 (JP) ..... JP2018-150361

(51) Int. Cl.

| | |
|---|---|
| ***H01F 17/00*** | (2006.01) |
| ***H01F 5/00*** | (2006.01) |
| ***H01F 41/04*** | (2006.01) |
| ***H01F 27/28*** | (2006.01) |

(52) U.S. Cl.

CPC ..... *H01F 17/0033* (2013.01); *H01F 5/003* (2013.01); *H01F 17/0013* (2013.01); *H01F 27/2804* (2013.01); *H01F 41/041* (2013.01); *H01F 2017/0066* (2013.01); *H01F 2027/2809* (2013.01)

(58) Field of Classification Search

CPC ..... H01F 17/0013; H01F 27/2804; H01F 2027/2809; H01F 17/0006; H01F 5/003; H01F 17/0033; H01F 2017/0066

USPC ..... 336/200, 232

See application file for complete search history.

(56) References Cited

U.S. PATENT DOCUMENTS

| | | | | |
|---|---|---|---|---|
| 5,515,022 A * | 5/1996 | Tashiro | H01F 17/0013 | 336/200 |
| 6,723,494 B2 * | 4/2004 | Nakata | H01L 23/49838 | 430/311 |
| 2005/0184848 A1 * | 8/2005 | Yoshida | H01F 41/046 | 336/223 |

(Continued)

FOREIGN PATENT DOCUMENTS

| | | |
|---|---|---|
| JP | H07201575 A | 8/1995 |
| JP | 2007-317851 A | 12/2007 |

(Continued)

OTHER PUBLICATIONS

Japanese Office Action issued in connection with corresponding Japanese Patent Application No. 2018-150361 dated Mar. 8, 2022.

(Continued)

*Primary Examiner* — Tszfungjchan

(74) *Attorney, Agent, or Firm* — Tarolli, Sundheim, Covell & Tummino LLP

(57) ABSTRACT

An inductor includes a first conductor, a second conductor, an insulation film, and a magnetic body. The first conductor spirally extends in a plane. The second conductor spirally extends in a plane. The second conductor is stacked on and joined to the first conductor. The insulation film covers a surface of the first conductor and a surface of the second conductor. The magnetic body covers a surface of the insulation film and embeds the first conductor and the second conductor. The first conductor and the second conductor are connected to form a helical coil.

9 Claims, 22 Drawing Sheets

(56) References Cited

U.S. PATENT DOCUMENTS

| | | | | |
|---|---|---|---|---|
| 2007/0273045 | A1 | 11/2007 | Kitada | |
| 2014/0292468 | A1* | 10/2014 | Motomiya | H01F 41/125 336/200 |
| 2017/0148562 | A1* | 5/2017 | Lee | H01F 17/04 |
| 2017/0162317 | A1* | 6/2017 | Taniguchi | H01F 41/046 |
| 2017/0287622 | A1 | 10/2017 | Ishizaki | |
| 2018/0218829 | A1* | 8/2018 | Endo | H01F 17/0013 |
| 2018/0277296 | A1* | 9/2018 | Endo | H01F 41/046 |
| 2019/0006100 | A1* | 1/2019 | Bong | H01F 17/0013 |
| 2019/0287727 | A1 | 9/2019 | Tomohiro | |
| 2019/0304666 | A1* | 10/2019 | Arai | H05K 1/111 |
| 2020/0335254 | A1 | 10/2020 | Park | |

FOREIGN PATENT DOCUMENTS

| | | | |
|---|---|---|---|
| JP | 2017-183529 | A | 10/2017 |
| JP | 2017-201718 | A | 11/2017 |
| JP | 2018-082092 | A | 5/2018 |
| WO | 2017/160032 | A1 | 9/2017 |
| WO | 2018/105364 | A1 | 6/2018 |

OTHER PUBLICATIONS

Office Action issued in corresponding Japanese Patent Application No. 2018-150361 dated Aug. 30, 2022.

* cited by examiner

INDUCTOR

CROSS-REFERENCE TO RELATED APPLICATIONS

This application is based upon and claims the benefit of priority from prior Japanese Patent Application No. 2018-150361, filed on Aug. 9, 2018, the entire contents of which are incorporated herein by reference.

FIELD

This disclosure relates to an inductor and a method for manufacturing an inductor.

BACKGROUND

In accordance with acceleration of miniaturization of recent electronic devices such as game devices and mobile phones, there is an increasing demand for miniaturization of various elements, such as inductors, mounted on electronic devices. An exemplary type of an inductor mounted on an electronic device includes winding and a core. Such type of inductor is used, for example, in a power supply circuit of an electronic device (refer to Japanese Laid-Open Patent Publication No. 07-201575).

In a typical type of an inductor such as that described above, the winding and the core are separate components and coupled to each other. Thus, the winding is inevitably spaced apart from the core by a gap. The gap hinders reduction in size and thickness of the inductor.

SUMMARY

An embodiment is an inductor that includes a first conductor, a second conductor, an insulation film, and a magnetic body. The first conductor spirally extends in a plane. The second conductor spirally extends in a plane. The second conductor is stacked on and joined to the first conductor. The insulation film covers a surface of the first conductor and a surface of the second conductor. The magnetic body covers a surface of the insulation film and embeds the first conductor and the second conductor. The first conductor and the second conductor are connected to form a helical coil.

Other embodiments and advantages thereof will become apparent from the following description, taken in conjunction with the accompanying drawings, illustrating by way of example the principles of the invention.

It is to be understood that both the foregoing general description and the following detailed description are exemplary and explanatory and are not restrictive of the invention, as claimed.

BRIEF DESCRIPTION OF THE DRAWINGS

The embodiments, together with objects and advantages thereof, may best be understood by reference to the following description of the presently preferred embodiments together with the accompanying drawings in which.

DESCRIPTION OF THE EMBODIMENTS

Figure 1:
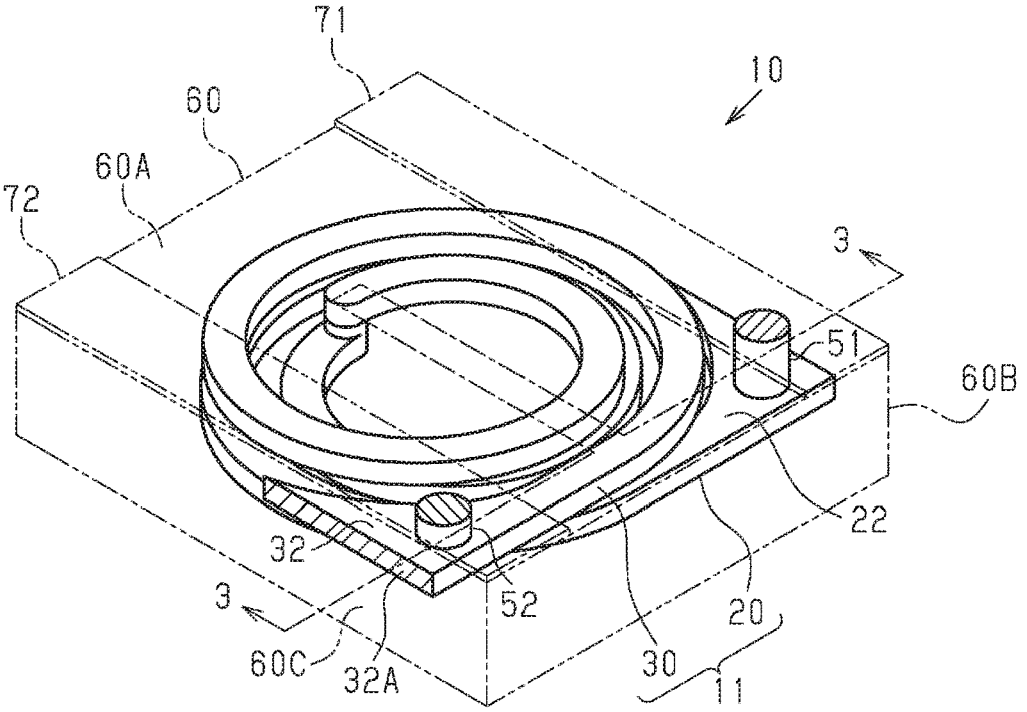
FIG. 1 is a schematic perspective view illustrating a first embodiment of an inductor.

Various embodiments will now be described with reference to the drawings. The drawings may not be to scale, and the relative size, proportions, and depiction of elements in the drawings may be exaggerated for clarity, illustration, and convenience. Moreover, to facilitate understanding, hatching lines may not be illustrated or be replaced by shadings in the cross-sectional drawings.

First Embodiment

A first embodiment will now be described with reference to FIGS. 1 to 11B. In the present specification, "plan view" refers to a view of a subject taken in a vertical direction (for example, upper-lower direction in FIG. 1), and "planar shape" refers to a shape of a subject taken in the vertical direction.

Figure 3:
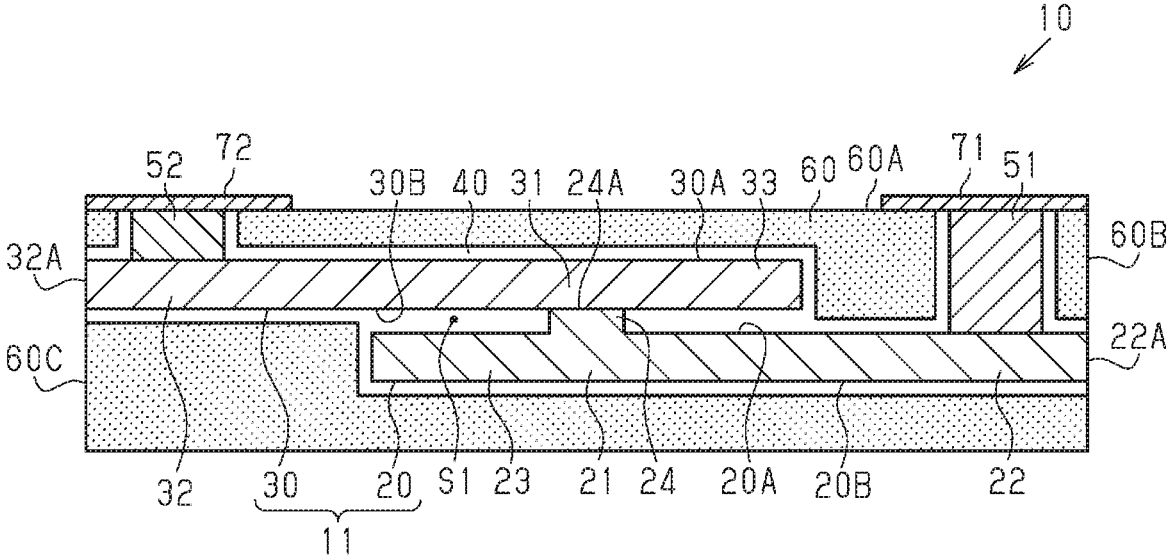
FIG. 3 is a schematic cross-sectional view of the inductor taken along line 3-3 in FIG. 1.

As illustrated in FIGS. 1 and 3, an inductor 10 includes conductors 20 and 30, each of which spirally extends, an insulation film 40 (not illustrated in FIG. 1) that covers surfaces of the conductors 20 and 30, a magnetic body 60 covering surfaces of the insulation film 40, and electrodes 71 and 72.

Figure 2:
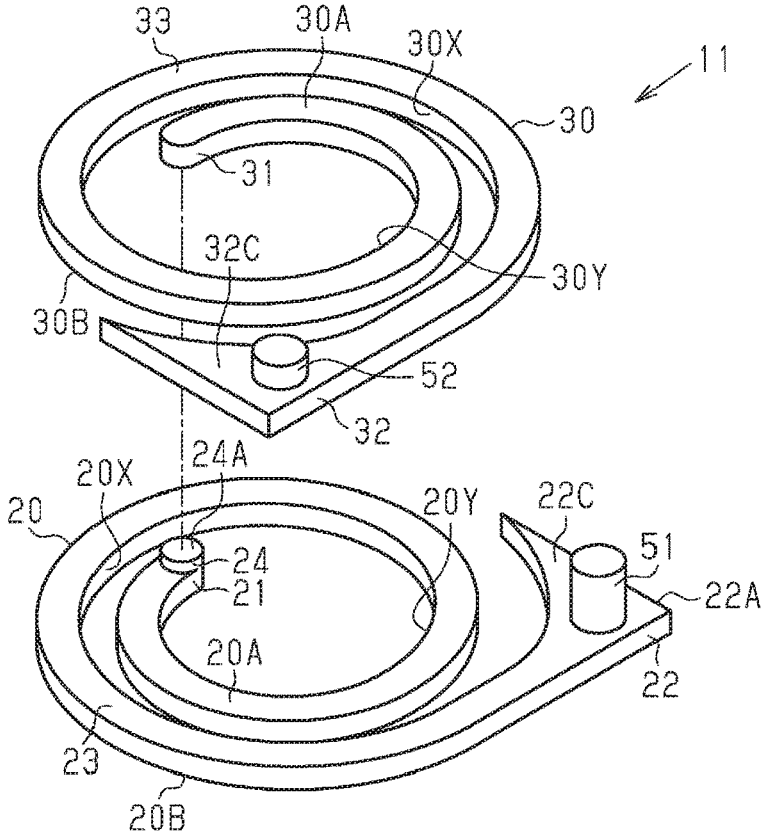
FIG. 2 is a schematic perspective view illustrating a coil of the inductor illustrated in FIG. 1.

As illustrated in FIG. 2, the conductor 20 spirally extends in a plane (on a plane). The conductor 20 is, for example, circularly spiral. The conductor 30 spirally extends in a plane. The conductor 30 is, for example, circularly spiral. In the present specification, the direction extending along the spirals of the conductors 20 and 30 is referred to as the longitudinal direction. The direction orthogonal to the longitudinal direction in a plan view is referred to as the transverse direction (widthwise direction). The direction orthogonal to the longitudinal direction and the transverse direction is referred to as the thickness-wise direction.

The sideward cross section of each of the conductors 20 and 30 (i.e., cross section of each of the conductors 20 and 30 that is cut along a plane orthogonal to the longitudinal direction) is, for example, rectangular. In the present example, the sideward cross section of each of the conductors 20 and 30 is rectangular and has short sides and long sides. The short sides extend in the thickness-wise direction, and the long sides extend in the transverse direction.

The material of the conductors 20 and 30 may be, for example, copper (Cu) or a Cu alloy. The material of the conductors 20 and 30 may be, for example, a Fe—Ni alloy such as Alloy 42.

Structure of Conductor 20

As illustrated in FIG. 2, the conductor 20 includes an end 21 located at the circumferentially inner side (hereafter, referred to as inner circumferential end 21), an end 22 located at the circumferentially outer side (hereafter, referred to as outer circumferential end 22), and a conductor portion 23 spirally extending from the inner circumferential end 21 toward the outer circumferential end 22. The inner circumferential end 21, the outer circumferential end 22, and the conductor portion 23 are formed integrally with each other as a single component.

The conductor portion 23 winds about a central point and extends away from the central point from the inner circumferential end 21 toward the outer circumferential end 22. In the present example, the conductor portion 23 is a circular spiral and winds approximately 1.5 turns to the left (counterclockwise) from the inner circumferential end 21 toward the outer circumferential end 22.

The conductor portion 23 includes spiral parts spaced apart by a given gap. Thus, the conductor 20 includes a spiral slit 20X extending between the adjacent spiral parts of the conductor portion 23. The conductor 20 also includes a circular opening 20Y located closer to the central point than the inner circumferential end 21.

The dimension of the conductor portion 23 in the transverse direction (widthwise direction) may be, for example, approximately 200 to 300 μm. The dimension of the conductor portion 23 in the thickness-wise direction may be, for example, approximately 100 to 200 μm. The dimension of the slit 20X in the transverse direction may be, for example, approximately 100 to 200 μm.

The inner circumferential end 21 is used as a joint portion joined to the conductor 30. The inner circumferential end 21 includes a projection 24 projecting toward the conductor 30 and joined to the conductor 30. The conductor 20 includes an upper surface 20A, which faces the conductor 30, and a lower surface 20B. The projection 24 projects from the upper surface 20A of the conductor 20 toward the conductor 30 and is located closer to the conductor 30 than other portions (in the example illustrated in FIG. 2, the conductor portion 23 and the outer circumferential end 22) of the conductor 20. The projection 24 is formed integrally with the other portions (in the present example, the conductor portion 23 and the outer circumferential end 22) of the conductor 20. The projection 24 may be formed, for example, by thinning portions of the conductor 20 excluding the projection 24.

As illustrated in FIG. 3, the projection 24 is rod-shaped and extends from the upper surface 20A of the inner circumferential end 21 toward the conductor 30. The height (thickness) of the projection 24 may be, for example, approximately 50 to 100 μm. The projection 24 may have any planar shape and any size. The planar shape of the projection 24 may be, for example, a circle having a diameter of approximately 200 to 400 μm.

The projection 24 includes, for example a planar upper surface 24A. The upper surface 24A of the projection 24 is used as a joint surface that is joined to the conductor 30.

The outer circumferential end 22 is used as a connector electrically connected to the electrode 71. The upper surface 20A of the outer circumferential end 22 is joined to, for example, a metal post 51. The metal post 51 is directly connected to the electrode 71. In the present example, the outer circumferential end 22 is electrically connected to the electrode 71 via the metal post 51. The outer circumferential end 22 includes an end surface 22A, for example, exposed in an end surface 60B of the magnetic body 60. The end surface 22A of the outer circumferential end 22 is, for example, flush with the end surface 60B of the magnetic body 60.

As illustrated in FIG. 2, the outer circumferential end 22 extends, for example, in a direction intersecting with the winding direction of the conductor portion 23. The outer circumferential end 22 includes a wide portion 22C that is, for example, greater in dimension in the transverse direction than the conductor portion 23. The lower surface of the metal post 51 is joined to the upper surface 20A of the wide portion 22C.

The metal post 51 is rod-shaped and extends upward from the upper surface 20A of the outer circumferential end 22 (in the present example, wide portion 22C). The height (thickness) of the metal post 51 may be, for example, approximately 400 to 500 μm. The metal post 51 may have any planar shape and any size. The planar shape of the metal post 51 may be, for example, a circle having a diameter of approximately 500 to 1000 μm.

Structure of Conductor 30

The conductor 30 includes an end 31 located at the circumferentially inner side (hereafter, referred to as inner circumferential end 31), an end 32 located at the circumferentially outer side (hereafter, referred to as outer circumferential end 32), and a conductor portion 33 spirally extending from the inner circumferential end 31 toward the outer circumferential end 32. The inner circumferential end 31, the outer circumferential end 32, and the conductor portion 33 are formed integrally with each other as a single component.

The conductor portion 33 winds about a central point and extends away from the central point from the inner circumferential end 31 toward the outer circumferential end 32. The winding direction of the conductor portion 33 is opposite to the winding direction of the conductor portion 23. In the present example, the conductor portion 33 is a circular spiral and winds approximately 1.5 turns to the right (clockwise) from the inner circumferential end 31 toward the outer circumferential end 32.

The conductor portion 33 includes spiral parts spaced apart by a given gap. Thus, the conductor 30 includes a spiral slit 30X extending between the adjacent spiral parts of the conductor portion 33. The conductor 30 also includes a circular opening 30Y located closer to the central point than the inner circumferential end 31.

The dimension of the conductor portion 33 in the transverse direction (widthwise direction) may be, for example, approximately 200 to 300 μm. The dimension of the conductor portion 33 in the thickness-wise direction may be, for example, approximately 100 to 200 μm. The dimension of the slit 30X in the transverse direction may be, for example, approximately 100 to 200 μm.

The inner circumferential end 31 is used as a joint portion joined to the conductor 20. The conductor 30 includes an upper surface 30A and a lower surface 30B, which faces the conductor 20. The lower surface 30B of the conductor 30 includes the lower surface of the inner circumferential end 31. The lower surface 30B of the inner circumferential end 31 is joined to the upper surface 24A of the projection 24. The lower surface 30B of the inner circumferential end 31 is coplanar with the lower surface 30B of other portions of the conductor 30, in the present example, the conductor portion 33 and the lower surface 30B of the outer circumferential end 32.

As illustrated in FIG. 3, the outer circumferential end 32 is used as a connector electrically connected to the electrode 72. The upper surface 30A of the outer circumferential end 32 is joined to, for example, a metal post 52. The metal post 52 is directly connected to the electrode 72. In the present example, the outer circumferential end 32 is electrically connected to the electrode 72 via the metal post 52. The outer circumferential end 32 includes an end surface 32A, for example, exposed in an end surface 60C of the magnetic body 60. The end surface 32A of the outer circumferential end 32 is, for example, flush with the end surface 60C of the magnetic body 60.

As illustrated in FIG. 2, the outer circumferential end 32 extends, for example, in a direction intersecting with the winding direction of the conductor portion 33. The outer circumferential end 32 includes a wide portion 32C that is greater in dimension in the transverse direction than the conductor portion 33. The lower surface of the metal post 52 is joined to the upper surface 30A of the wide portion 32C.

The metal post 52 is rod-shaped and extends upward from the upper surface 30A of the outer circumferential end 32 (in the present example, the wide portion 32C). The height (thickness) of the metal post 52 may be, for example, approximately 200 to 300 μm. The metal post 52 may have any planar shape and any size. The planar shape of the metal post 52 may be, for example, a circle having a diameter of approximately 500 to 1000 μm.

The conductor 30 is stacked on and joined to the conductor 20. In the present example, the projection 24 on the inner circumferential end 21 of the conductor 20 is joined to the inner circumferential end 31 of the conductor 30, which is stacked on the conductor 20 vertically (in thickness-wise direction). The conductors 20 and 30 (conductor portions 23 and 33), which are vertically adjacent to each other, are spiral in opposite directions. Thus, the vertically adjacent conductors 20 and 30 are connected in series so that current flows in the conductors 20 and 30 in the same direction. This forms, as illustrated in FIG. 1, a helical coil 11 extending from the outer circumferential end 22 of the conductor 20 to the outer circumferential end 32 of the conductor 30. Thus, the metal post 51 is connected to the outer circumferential end 22, which is located on one end of the helical coil 11. The metal post 52 is connected to the outer circumferential end 32, which is located on the other end of the helical coil 11.

As illustrated in FIG. 3, the helical coil 11 has a given gap S1 between the conductors 20 and 30 that are vertically stacked. In the present example, the gap S1 corresponds to the thickness of the projection 24 located between the upper surface 20A of the conductor 20 and the lower surface 30B of the conductor 30.

Structure of Insulation Film 40

The insulation film 40 covers surfaces of the conductor 20 and surfaces of the conductor 30. For example, the insulation film 40 covers the entire upper surface 20A of the conductor 20 excluding a portion covered by the metal post 51, the entire lower surface 20B of the conductor 20, and the side surfaces of the conductor 20. In the present example, the insulation film 40 exposes the end surface 22A of the outer circumferential end 22 of the conductor 20. Additionally, the insulation film 40 covers, for example, the entire upper surface 30A of the conductor 30 excluding a portion covered by the metal post 52, the entire lower surface 30B of the conductor 30 excluding a portion covered by the projection 24, and the side surfaces of the conductor 30. In the present example, the insulation film 40 exposes the end surface 32A of the outer circumferential end 32 of the conductor 30. Additionally, the insulation film 40 covers, for example, the entire side surface of the metal post 51 and the entire side surface of the metal post 52. In the present example, the insulation film 40 exposes the upper surface of the metal post 51 and the upper surface of the metal post 52. In the present example, the insulation film 40 fills the gap S1 between the conductors 20 and 30 that are vertically adjacent to each other. The insulation film 40 prevents the conductors 20 and 30, which are vertically adjacent to each other, from shorting via a conductive element included in the magnetic body 60.

The material of the insulation film 40 may be, for example, an insulative resin such as an epoxy resin or a polyimide resin. The insulation film 40 may include, for example, a filler such as silica or alumina. The thickness of the insulation film 40 may be, for example, approximately 10 to 30 μm.

Structure of Magnetic Body 60

The magnetic body 60 entirely encapsulates the helical coil 11 formed by the conductors 20 and 30, the metal posts 51 and 52, and the insulation film 40. The magnetic body 60 directly covers the surface of the insulation film 40, which covers the surfaces of the conductors 20 and 30. In other words, the magnetic body 60 directly covers the surfaces of the conductors 20 and 30 via the insulation film 40. Namely, the conductors 20 and 30 are embedded in the magnetic body 60. Thus, the magnetic body 60 fills the slits 20X and 30X and the openings 20Y and 30Y, which are illustrated in FIG. 2. In the present example, the metal posts 51 and 52 are also embedded in the magnetic body 60. For example, the magnetic body 60 exposes the end surface 22A of the outer circumferential end 22 of the conductor 20, the end surface 32A of the outer circumferential end 32 of the conductor 30, and the upper surfaces (end surfaces) of the metal posts 51 and 52. The magnetic body 60 includes an upper surface 60A that is flush with, for example, the upper surfaces of the metal posts 51 and 52 and the upper surface (end surface) of the insulation film 40 covering the side surfaces of the metal posts 51 and 52. The end surface 60B of the magnetic body 60 is flush with, for example, the end surface 22A of the outer circumferential end 22 and the side surface (end surface) of the insulation film 40 covering the upper surface 20A and the lower surface 20B of the outer circumferential end 22. The end surface 60C of the magnetic body 60, which is opposite to the end surface 60B, is flush with, for example, the end surface 32A of the outer circumferential end 32 and the side surface (end surface) of the insulation film 40 covering the upper surface 30A and the lower surface 30B of the outer circumferential end 32.

As illustrated in FIG. 1, the magnetic body 60 has the form of, for example, a hexahedron. In the present example, the magnetic body 60 is rectangular box-shaped. The thickness of the magnetic body 60 may be, for example, approximately 1 to 1.5 mm. The planar shape of the magnetic body 60 may be a tetragon having sides of approximately 3 mm×3 mm to 4 mm×4 mm.

The material of the magnetic body 60 may be a material obtained, for example, by kneading magnetic particles and an insulative resin. The magnetic particles may be, for example, carbonyl iron, ferrite, or permalloy. The insulative resin is used as a binder (bonding material). The insulative resin may be a thermosetting resin or a thermoplastic resin such as an epoxy resin, a polyimide resin, a phenol resin, or an acrylic resin.

The electrode 71 is formed on the upper surface 60A of the magnetic body 60 and is connected to the upper surface (end surface) of the metal post 51. The electrode 71 is electrically connected to the conductor 20 via the metal post 51. The electrode 72 is formed on the upper surface 60A of the magnetic body 60 and is connected to the upper surface (end surface) of the metal post 52. The electrode 72 is electrically connected to the conductor 30 via the metal post 52. The electrodes 71 and 72 are spaced apart from each other. The electrodes 71 and 72 each extend like a strip.

A method for manufacturing the inductor 10 will now be described. To facilitate understanding, portions that ultimately become elements of the inductor 10 are indicated by reference characters used to denote the final element.

A method for manufacturing the conductor 20 will now be described.

Figure 4A:
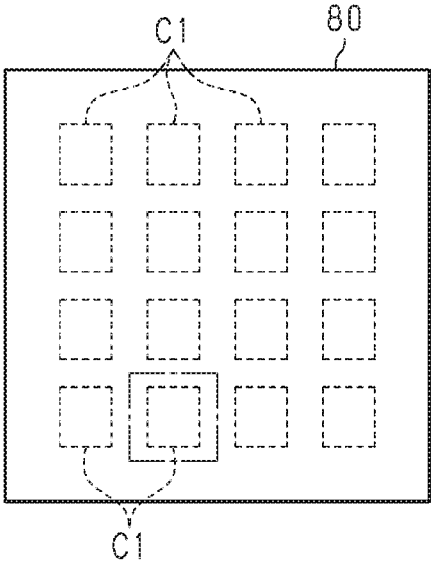
FIG. 4A is a schematic plan view illustrating a method for manufacturing the inductor (first conductor) illustrated in FIG. 1.
Figure 4B:
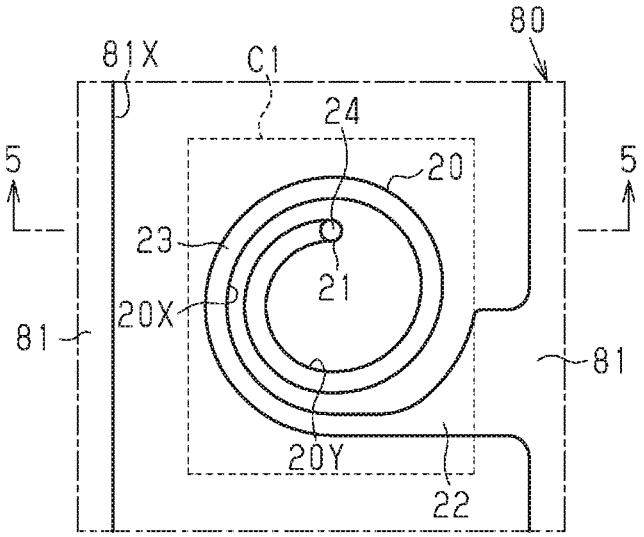
FIG. 4B is an enlarged plan view illustrating one of the separate regions illustrated in FIG. 4A.

In the step illustrated in FIG. 4A, a metal plate 80 is prepared. The metal plate 80 includes separate regions C1. The separate regions C1 are arranged, for example, in a matrix (in the example illustrated in FIG. 4A, 4×4). As illustrated in FIG. 4B, the spiral conductor 20 is formed in each separate region C1 by performing the manufacturing steps described below. At this time, the conductor 20 formed in each separate region C1 is connected to, for example, a connecting portion 81 located between the separate region C1 and an adjacent separate region C1. Each conductor 20 is defined by an opening 81X extending between the adjacent connecting portions 81. Finally, the separate regions C1 are cut along cutting lines, which are indicated by broken lines, to singulate separate conductors 20. The separate regions C1 may be arranged at given intervals as illustrated in FIG. 4A or may abut each other.

For example, a copper plate having a thickness of approximately 150 to 250 μm may be used as the metal plate 80. The material of the metal plate 80 is not limited to copper and may be a copper alloy or a Fe—Ni alloy such as Alloy 42.

A process for forming the conductor 20 in each separate region C1 will now be described with reference to FIGS. 5A to 6C. The steps of forming the conductor 20 are included in the method for manufacturing the inductor 10. For the sake of convenience, the following description will focus on a single separate region C1. FIGS. 5A to 6C illustrate cross-sectional views of the metal plate 80 taken at a position corresponding to line 5-5 in FIG. 4B.

Figure 5A:
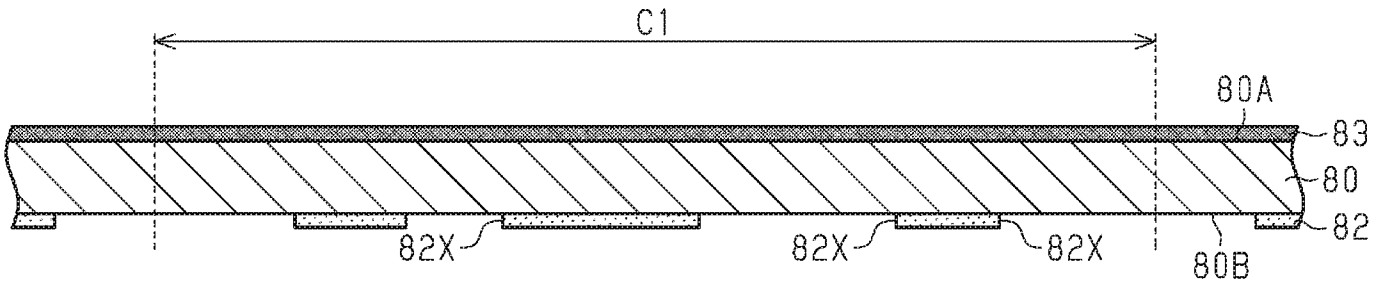
FIGS. 5A to 5C and 6A to 6C are schematic cross-sectional views illustrating a method for manufacturing the inductor (first conductor) following the step illustrated in FIG. 4A.

In the step illustrated in FIG. 5A, a resist layer 82 including open patterns 82X in given positions is formed on a lower surface 80B of the metal plate 80, which is prepared in the step illustrated in FIG. 4A. The resist layer 82 covers the lower surface 80B of the metal plate 80 on portions corresponding to the conductor 20 and the connecting portion 81 illustrated in FIG. 4B. For example, a material having resistance to etching performed in the next step may be used as the material of the resist layer 82. For example, a photosensitive dry film resist or a liquid photoresist may be used as the resist layer 82. Such a resist material may be, for example, a novolac resin or an acrylic resin. For example, when a photosensitive dry film resist is used, the lower surface 80B of the metal plate 80 is laminated with a dry film through thermocompression bonding, and the dry film is patterned through photolithography to form the resist layer 82 including the open patterns 82X. When a liquid photoresist is used, the resist layer 82 may also be formed by the same steps.

Additionally, a resist layer 83 is formed on an upper surface 80A of the metal plate 80 to cover the entire upper surface 80A. The material of the resist layer 83 may be the same as the material of the resist layer 82. The resist layer 83 may be formed, for example, by laminating the upper surface 80A of the metal plate 80 with a dry film through thermocompression bonding.

Figure 5B:
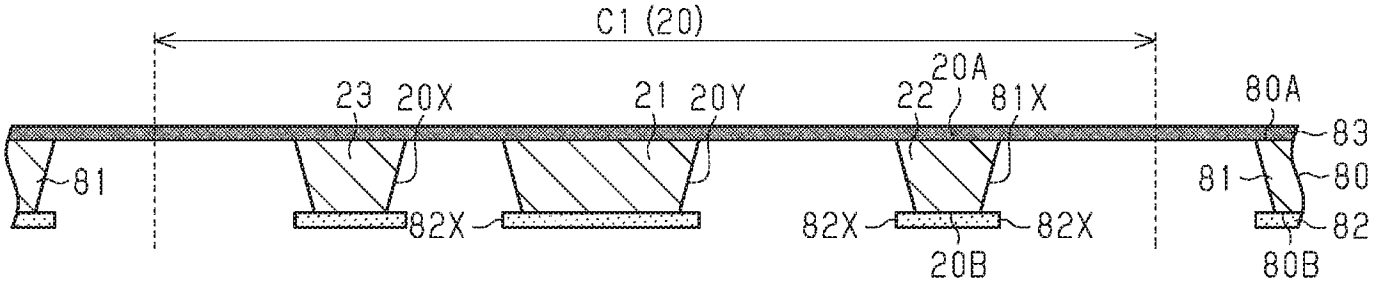

In the step illustrated in FIG. 5B, as the resist layers 82 and 83 are used as etching masks, the lower surface 80B of the metal plate 80 is etched. This forms the conductor 20 that is spiral in a plane. In the present example, the lower surface 80B of the metal plate 80 exposed in the open patterns 82X of the resist layer 82 is etched so that the spiral slit 20X, the circular opening 20Y, and the opening 81X are formed in the metal plate 80. As a result, the spiral conductor 20 is formed in each separate region C1, and the connecting portions 81 connecting adjacent ones of the conductors 20 are formed. The type of etching that patterns the metal plate 80 may be wet etching (isotropic etching). In this case, the etchant used in wet etching may be selected in accordance with the material of the metal plate 80. For example, in a case in which copper is used as the metal plate 80, a ferric chloride aqueous solution or a cupric chloride aqueous solution may be used as the etchant. Spray etching may be performed from the lower surface 80B of the metal plate 80 to pattern the metal plate 80. As described above, when the metal plate 80 is patterned through wet etching, side etching phenomenon in which the etching proceeds in the in-plane direction of the metal plate 80 occurs. This shapes the conductor 20 to have a trapezoidal cross section. Thus, the planar shape of the lower surface 20B of the conductor 20 has a slightly smaller dimension than the planar shape of the upper surface 20A of the conductor 20.

In the present example, the metal plate 80 is patterned (i.e., the slit 20X, the opening 20Y, and the openings 81X are formed) by etching. Instead, the metal plate 80 may be patterned, for example, by stamping.

Then, the resist layers 82 and 83 are removed by an alkaline stripping solution (e.g., organic amine stripping solution, caustic soda, acetone, or ethanol).

Figure 5C:
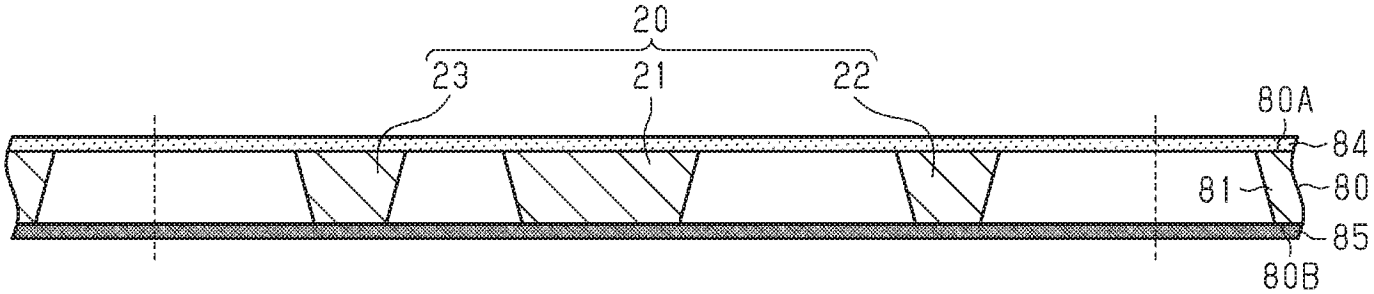

In the step illustrated in FIG. 5C, a resist layer 84 is formed to cover the entire upper surface 80A of the metal plate 80 (the conductor 20 and the connecting portion 81), and a resist layer 85 is formed to cover the entire lower surface 80B of the metal plate 80. The material of the resist layers 84 and 85 may be, for example, the same as the material of the resist layers 82 and 83 (refer to FIG. 5B). The resist layers 84 and 85 may be formed, for example, in the same process as the resist layers 82 and 83.

Figure 6A:
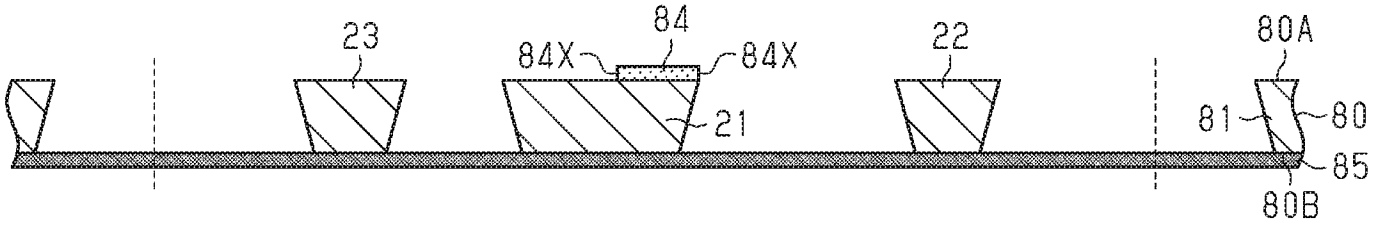

In the step illustrated in FIG. 6A, the resist layer 84 is patterned, for example, through photolithography so that open patterns 84X are formed in the resist layer 84. The open patterns 84X expose the upper surface 80A of the metal plate 80 excluding a portion corresponding to the inner circumferential end 21 of the conductor 20. In other words, the resist layer 84 covers the upper surface 80A of the metal plate 80 on the portion corresponding to the inner circumferential end 21 of the conductor 20.

Figure 6B:
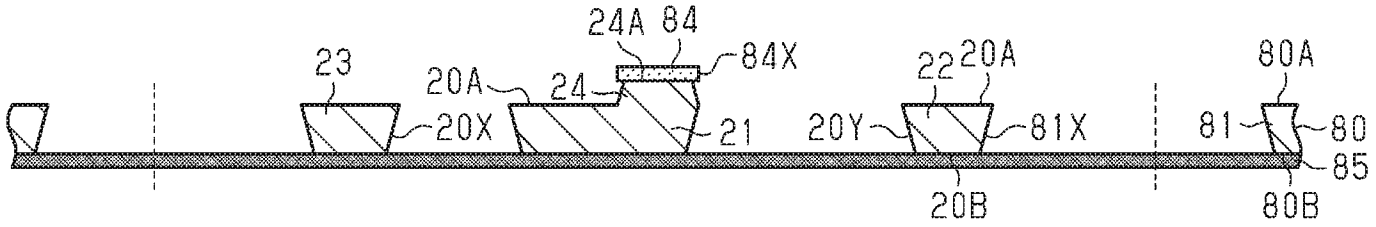

In the step illustrated in FIG. 6B, as the resist layers 84 and 85 are used as etching masks, the upper surface 80A of the metal plate 80 is etched (half-etched). As a result, the metal plate 80 exposed in the open patterns 84X of the resist layer 84 is thinned to form the projection 24 on the inner circumferential end 21. As described above, the projection 24 projecting more than other portions in the thickness-wise direction is formed by thinning the conductor 20 (metal plate 80) excluding the portion corresponding to the inner circumferential end 21. In the step illustrated in FIG. 6B, for example, wet etching (isotropic etching) is performed. Such wet etching may be performed in the same manner as the wet etching illustrated in FIG. 5B. When the metal plate 80 is thinned by the wet etching, side etching phenomenon in which the etching proceeds in the in-plane direction of the metal plate 80 occurs. This shapes the projection 24 to have a trapezoidal cross section. In the present example, the projection 24 is tapered so that the width (diameter) is decreased from the lower surface side (bottom of projection 24) toward the upper surface 24A in FIG. 6B. For example, the projection 24 is shaped as a truncated cone in which the upper surface 24A is smaller than the lower surface side (bottom). The metal plate 80 is thinned, for example, so that the projection 24 has a height of approximately 50 to 100 μm.

As described above, in the present example, the first wet etching (i.e., formation of the slit 20X, the opening 20Y, and the openings 81X) is performed from the lower surface 80B of the metal plate 80. The second wet etching (i.e., formation of the projection 24) is performed from the upper surface 80A of the metal plate 80. That is, the surface (the upper surface 80A) of the metal plate 80 on which the second wet etching is performed to form the projection 24 is opposite to the surface (the lower surface 80B) of the metal plate 80 on which the first wet etching is performed. Thus, the projection 24 is not formed on the lower surface 20B of the conductor 20, which has a planar shape that is reduced in size by the first wet etching, but formed on the upper surface 20A of the conductor 20, which has a larger planar shape than the lower surface 20B. This prevents the dimension of the planar shape of the projection 24 from decreasing beyond a desired dimension. Further, after the second wet etching, the planar shape of the upper surface 20A of the conductor 20 remains greater in size than the planar shape of the lower surface 20B of the conductor 20.

In the present example, the metal plate 80 is thinned, that is, the projection 24 is formed, by etching (half etching). Instead, the metal plate 80 may be thinned, for example, by stamping.

Figure 6C:
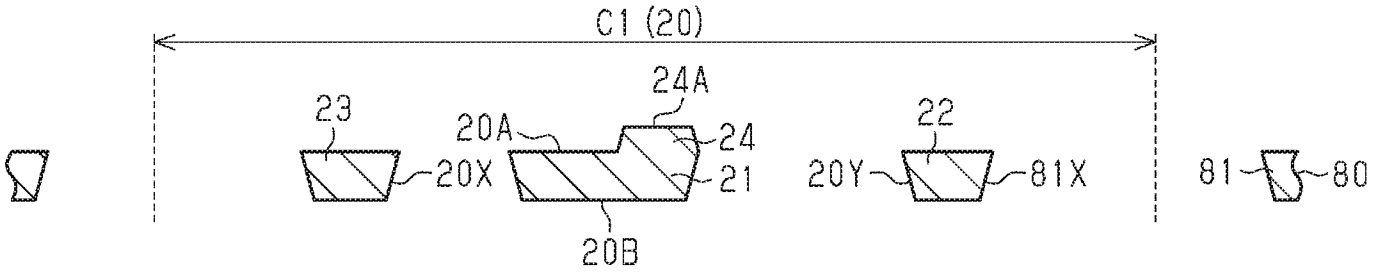

In the step illustrated in FIG. 6C, the resist layers 84 and 85 illustrated in FIG. 6B are removed by an alkaline stripping solution (e.g., organic amine stripping solution, caustic soda, acetone, or ethanol). As a result, the upper surface 24A of the projection 24 is exposed to the exterior.

Figure 7A:
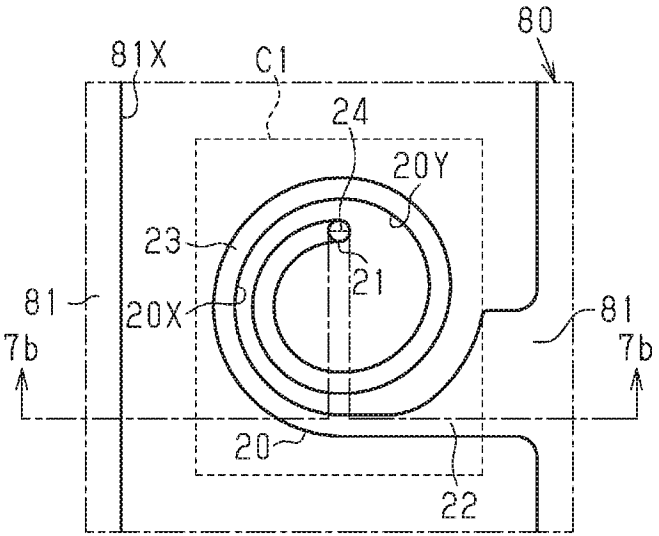
FIG. 7A is an enlarged plan view of the structural body (first conductor) illustrated in FIG. 6C.
Figure 7B:
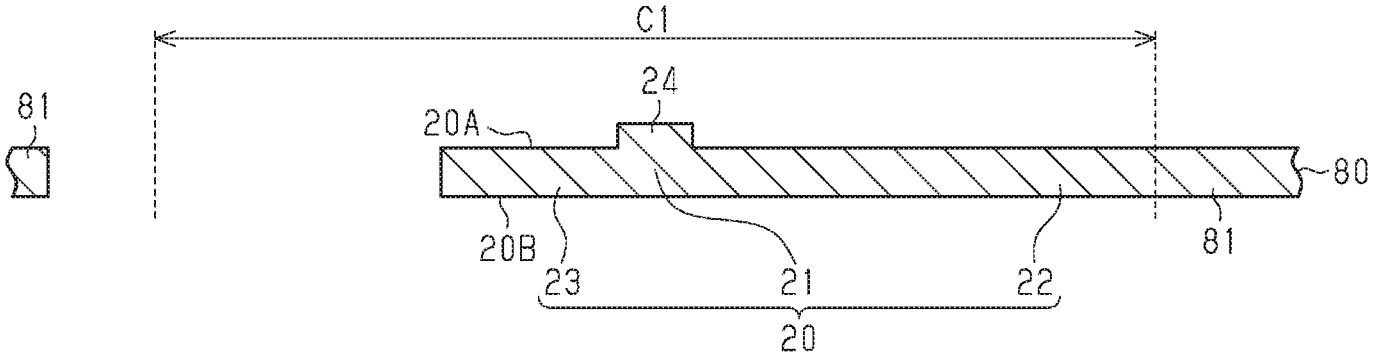
FIG. 7B is a schematic cross-sectional view taken along line 7*b*-7*b* in FIG. 7A.

As illustrated in FIGS. 7A and 7B, the manufacturing steps described above form the conductor 20 that includes the inner circumferential end 21, the outer circumferential end 22, and the conductor portion 23 spirally extending from the inner circumferential end 21 toward the outer circumferential end 22 in each separate region C1. To simplify the drawings, in FIGS. 7B and 8B to 11B, side surfaces of the conductors 20 and 30 extend orthogonal to the lower surfaces 20B and 30B of the conductors 20 and 30.

A process for forming the conductor 30 will now be described. The steps of forming the conductor 30 are included in the method for manufacturing the inductor 10.

Figure 8B:
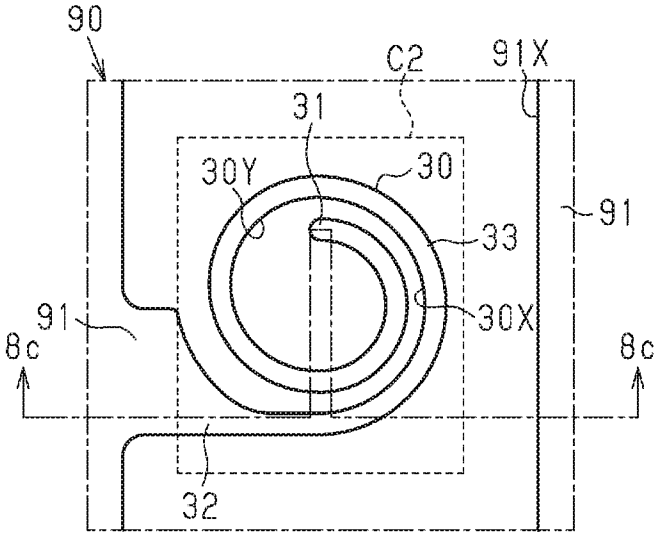
FIG. 8B is an enlarged plan view illustrating one of the separate regions illustrated in FIG. 8A.
Figure 8A:
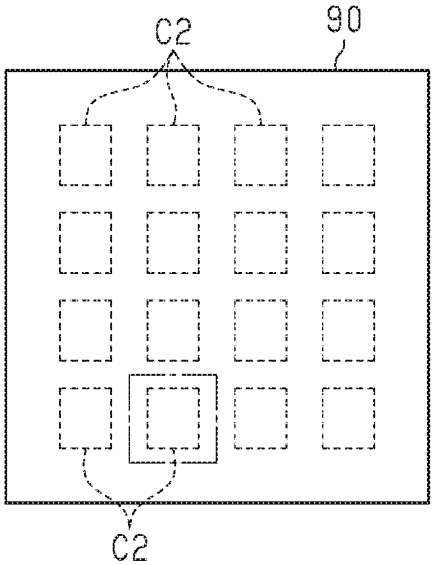
FIG. 8A is a schematic plan view illustrating the method for manufacturing the inductor (second conductor) illustrated in FIG. 1.
Figure 8C:
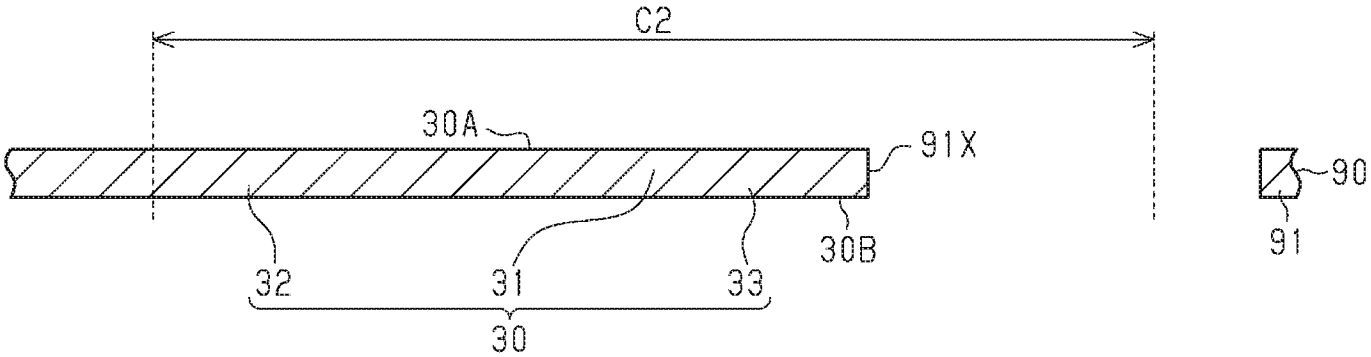
FIG. 8C is a schematic cross-sectional view taken along line 8*c*-8*c* illustrated in FIG. 8B.

In the step illustrated in FIG. 8A, a metal plate 90 is prepared. For example, a copper plate having a thickness of approximately 100 to 200 μm may be used as the metal plate 90. The material of the metal plate 90 is not limited to copper and may be a copper alloy or a Fe—Ni alloy such as Alloy 42. In the same manner as in the metal plate 80, the metal plate 90 includes separate regions C2. The separate regions C2 are arranged, for example, in a matrix (in the example illustrated in FIG. 8A, 4×4). As illustrated in FIGS. 8B and 8C, the conductor 30 that includes the inner circumferential end 31, the outer circumferential end 32, and the conductor portion 33 spirally extending from the inner circumferential end 31 toward the outer circumferential end 32 is formed in each separate region C2. At this time, the conductor 30 formed in each separate region C2 is connected to, for example, a connecting portion 91 located between the separate region C2 and an adjacent separate region C2. Each conductor 30 is defined by an opening 91X extending between the adjacent connecting portions 91. The conductor 30 and the connecting portions 91 described above may be formed in the same manufacturing steps as illustrated in FIGS. 5A and 5B. Thus, the description will be omitted.

FIGS. 9A to 11B, which will be described below, illustrate cross-sectional views of an inductor in a manufacturing process taken at positions corresponding to line 7*b*-7*b* in FIG. 7A and line 8*c*-8*c* in FIG. 8B.

Figure 9A:
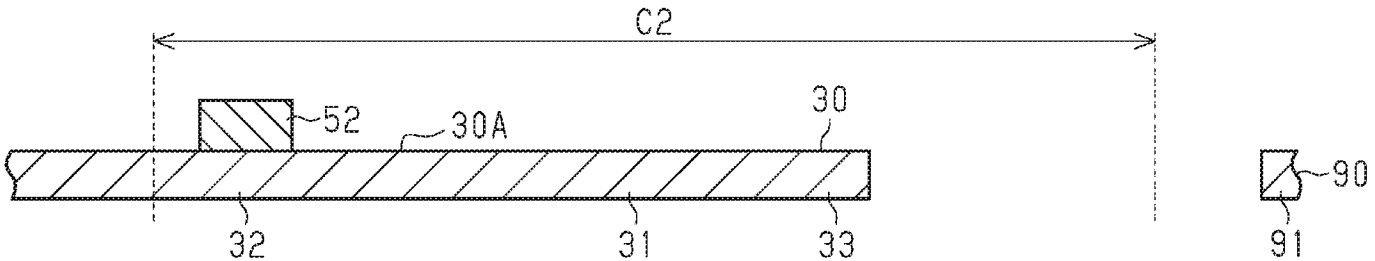
FIGS. 9A to 9C, 10A to 10C, 11A, and 11B are schematic cross-sectional views illustrating the method for manufacturing the inductor following the step illustrated in FIG. 8C.

In the step illustrated in FIG. 9A, the metal post 52 is joined to the upper surface 30A of the outer circumferential end 32 of the conductor 30. For example, diffusion bonding is used to join the conductor 30 and the metal post 52. Diffusion bonding is a technique that applies heat and pressure to metal materials arranged in close contact with each other in a vacuum or inert gas environment so that the metal materials are joined to each other at an atomic level by diffusion of atoms that occurs in the joined surfaces of the metal materials. In the present example, heat and pressure are applied to the metal post 52 stacked on the upper surface 30A of the outer circumferential end 32 in a vacuum so that diffusion bonding is performed. For example, when copper is used as the material of the conductor 30 and the metal post 52, the heating temperature may be set to approximately 500° C. to 600° C., and the pressure may be set to 0.005 to 0.015 kN/mm$^2$.

Figure 9B:
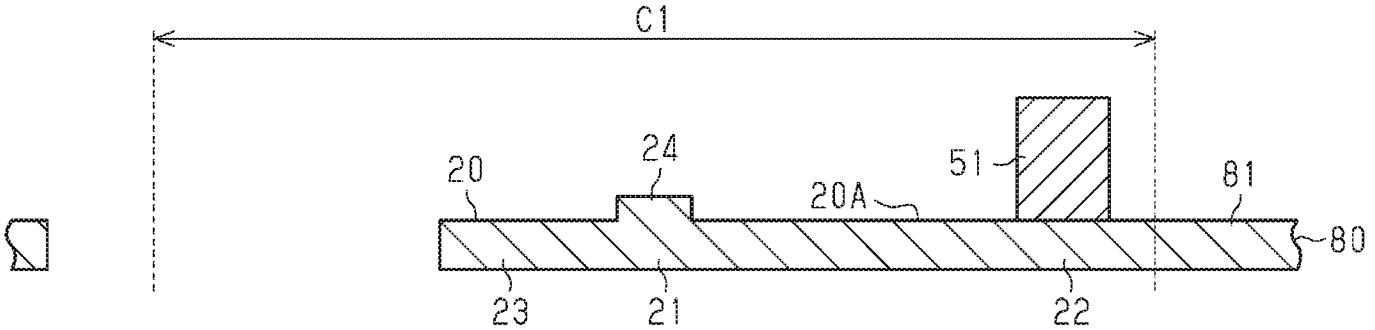

In the step illustrated in FIG. 9B, the metal post 51 is joined to the upper surface 20A of the outer circumferential end 22 of the conductor 20. For example, diffusion bonding is used to join the conductor 20 and the metal post 51. In the present example, diffusion bonding is performed by applying heat and pressure to the metal post 51 stacked on the upper surface 20A of the outer circumferential end 22 in a vacuum. For example, when copper is used as the material of the conductor 20 and the metal post 51, the heating temperature may be set to approximately 500° C. to 600° C., and the pressure may be set to 0.005 to 0.015 kN/mm$^2$.

The conductor 30 and the metal post 52 that are diffusion-bonded are integrated without a boundary surface (i.e., with no gap), and the upper surface 30A of the conductor 30 (outer circumferential end 32) is directly joined to the lower surface of the metal post 52. In the same manner, the conductor 20 and the metal post 51 that are diffusion-bonded are integrated without a boundary surface (i.e., with no gap), and the upper surface 20A of the conductor 20 (outer circumferential end 22) is directly joined to the lower surface of the metal post 51.

Figure 9C:
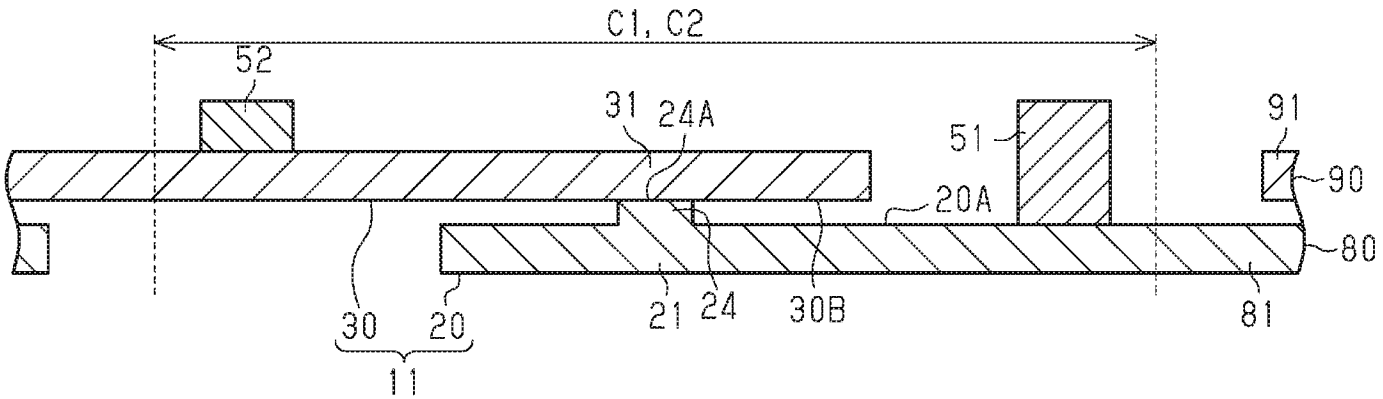

In the step illustrated in FIG. 9C, the conductor 20 is joined to the conductor 30. For example, the lower surface 30B of the inner circumferential end 31 of the conductor 30 is joined to the upper surface 24A of the projection 24, which is formed on the inner circumferential end 21 of the conductor 20. The projection 24 (inner circumferential end 21) of the conductor 20 and the inner circumferential end 31 of the conductor 30 are jointed, for example, by diffusion bonding.

In the present example, in the step illustrated in FIG. 9C, the metal plate 90 is located above the metal plate 80 so that the separate regions C1 arranged 4×4 in the metal plate 80 are vertically aligned with the separate regions C2 arranged 4×4 in the metal plate 90. The conductors 20 and 30 are positioned so that the lower surface 30B of the conductor 30 faces the upper surface 20A of the conductor 20, in the present example, so that the inner circumferential end 31 of the conductor 30 faces the projection 24 (inner circumferential end 21) of the conductor 20. The lower surface 30B of the inner circumferential end 31 is stacked on the upper surface 24A of the projection 24, and diffusion bonding is performed by applying heat and pressure to the conductors 20 and 30 in a vacuum. For example, when copper is used as the material of the conductors 20 and 30, the heating temperature may be set to approximately 500° C. to 600° C., and the pressure may be set to 0.005 to 0.015 kN/mm$^2$.

The projection 24 (inner circumferential end 21) and the inner circumferential end 31 that are diffusion-bonded are integrated without a boundary surface (i.e., with no gap), and the upper surface 24A of the projection 24 is directly joined to the lower surface 30B of the outer circumferential end 32.

The manufacturing steps described above connect the conductors 20 and 30, which are vertically stacked, in series, and form a helical coil 11 having approximately three turns.

Figures 10A, 10B, 10C:
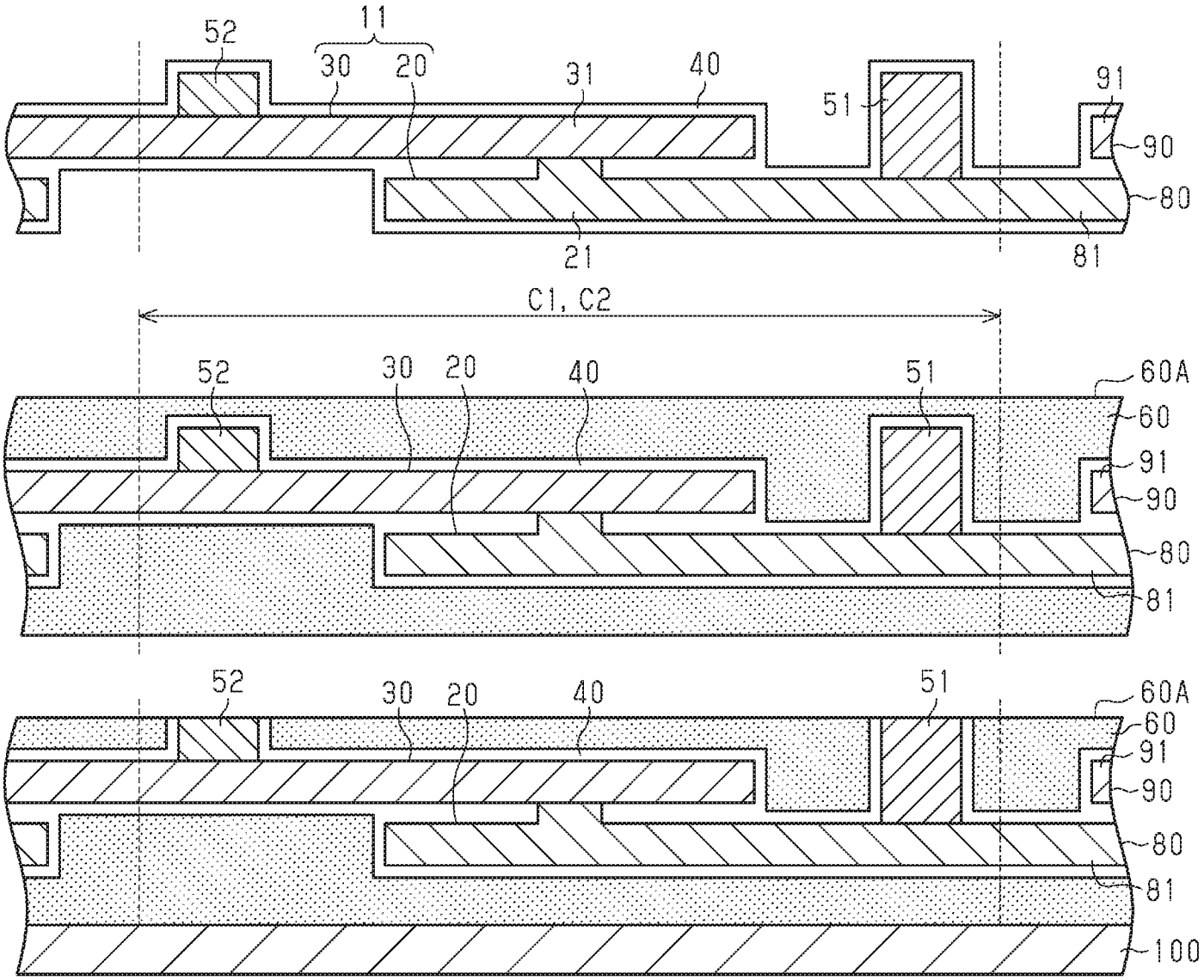

In the step illustrated in FIG. 10A, the insulation film 40 is formed to cover the entire surface of the conductors 20 and 30 and the entire surface of the metal posts 51 and 52. The insulation film 40 also covers the entire surface of the connecting portions 81 and 91. The insulation film 40 may be formed, for example, by electrodeposition coating. Alternatively, the insulation film 40 may be formed, for example, by spin coating or spray coating.

In the step illustrated in FIG. 10B, the magnetic body 60 is formed to cover the surface of the insulation film 40. Thus, the magnetic body 60 embeds the conductors 20 and 30 and the insulation film 40, which covers the conductors 20 and 30. In the present example, the magnetic body 60 entirely embeds the metal plates 80 and 90. Thus, the magnetic body 60 also embeds the connecting portions 81 located between adjacent ones of the separate regions C1, the connecting portions 91 located between adjacent ones of the separate regions C2, and the insulation film 40 covering the connecting portions 81 and 91. In addition, the magnetic body 60 embeds the metal posts 51 and 52 and the insulation film 40 covering the metal posts 51 and 52. The process of forming the magnetic body 60 is not particularly illustrated in the drawings. For example, the structural body illustrated in FIG. 10A is placed between a lower mold and an upper mold, and the cavity in the molds is filled with a magnetic powder element obtained by kneading magnetic powder and an insulative resin so that the structural body illustrated in FIG. 10A is surrounded by the magnetic powder element. As the magnetic powder element is heated to approximately 150° C. to 160° C., pressure of approximately 200 to 250 MPa is applied to the magnetic powder element from both the lower mold and the upper mold. The magnetic powder element is high-pressure-molded to form the magnetic body 60.

In the present example, the magnetic powder element is high-pressure-molded to form the magnetic body 60. However, the process of forming the magnetic body 60 is not limited to high-pressure molding. The magnetic body 60 may be formed, for example, by transfer molding or a compression molding.

In the step illustrated in FIG. 10C, the structural body illustrated in FIG. 10B is fixed to the upper surface of a support substrate 100. Then, brush polishing or blasting is performed to polish the upper surface 60A of the magnetic body 60 and the insulation film 40, which covers the upper surfaces of the metal posts 51 and 52, so that the upper surfaces (end surfaces) of the metal posts 51 and 52 are exposed through the magnetic body 60.

Figure 11A:
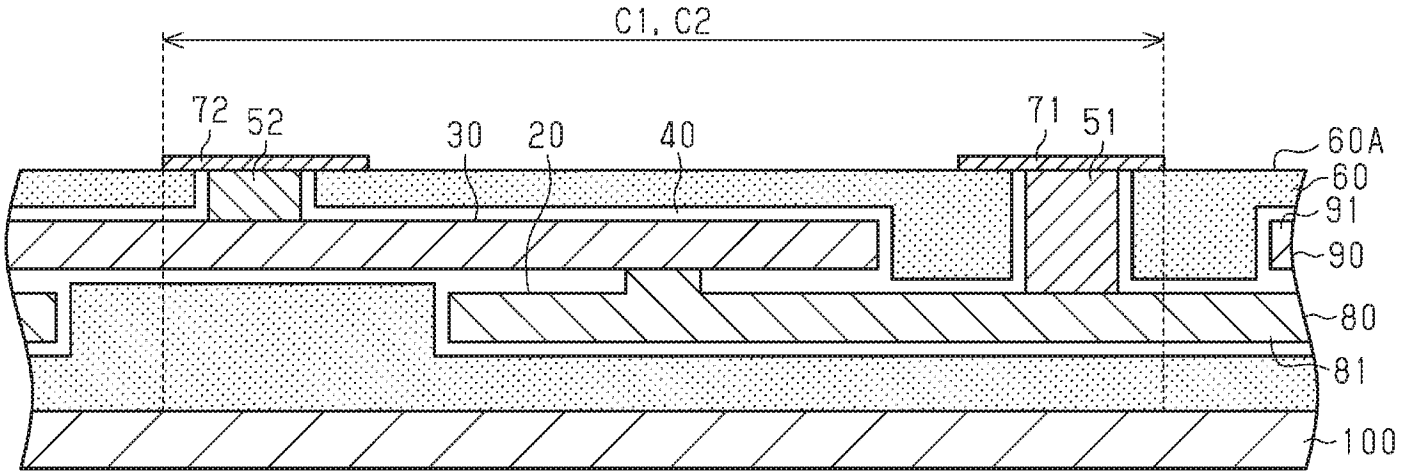

In the step illustrated in FIG. 11A, the electrode 71 is formed on the upper surface 60A of the magnetic body 60 to cover the upper surface of the metal post 51, and the electrode 72 is formed on the upper surface 60A of the magnetic body 60 to cover the upper surface of the metal post 52. The electrodes 71 and 72 may be formed, for example, by sputtering or vapor deposition. For example, a metal film having a two-layer structure in which a Ti layer formed of titanium (Ti) and a Cu layer formed of copper (Cu) are sequentially stacked on the upper surface of the metal posts 51 and 52 may be used as the electrodes 71 and 72. In this case, the thickness of the Ti layer may be, for example, approximately 0.1 to 0.3 μm, and the thickness of the Cu layer may be, for example, approximately 0.5 to 1.0 μm. The Ti layer is used as a metal barrier layer that inhibits dispersion of copper from the Cu layer and the metal posts 51 and 52 into the insulation film 40 and the magnetic body 60. The Ti layer has a greater adhesion to the magnetic body 60 than the Cu layer. Hence, the Ti layer is also used as an adhesion layer that adheres to the magnetic body 60 and the Cu layer. The material of a metal film that is used as the metal barrier layer and the adhesion layer may be titanium nitride (TiN), tantalum nitride (TaN), tantalum (Ta), or chromium (Cr) instead of Ti. The layer structure of the electrodes 71 and 72 is not limited to the two-layer structure and may be a single layer structure or a multilayer structure having three or more layers.

As necessary, a surface-processed layer is formed on surfaces (both upper and side surfaces or only upper surface) of the electrodes 71 and 72. Examples of the surface-processed layer include a gold (Au) layer, a nickel (Ni)/tin (Sn) layer (metal layer in which Ni layer is used as bottom layer, and Sn layer is formed on Ni layer), a Ni layer/Au layer (metal layer in which Ni layer is used as bottom layer, and Au layer is formed on Ni layer), or a silver (Ag) layer/Sn layer (metal layer in which Ag layer is used as bottom layer, and Sn layer is formed on Ag layer). Each of the Au layer, the Ni layer, the Sn layer, and the Ag layer may be, for example, an electroless plated metal layer formed through an electroless metal plating method. Such a surface-processed layer may be used to improve the solder wettability of the electrodes 71 and 72 in addition to being used as an antioxidant layer for the electrodes 71 and 72.

Figure 11B:
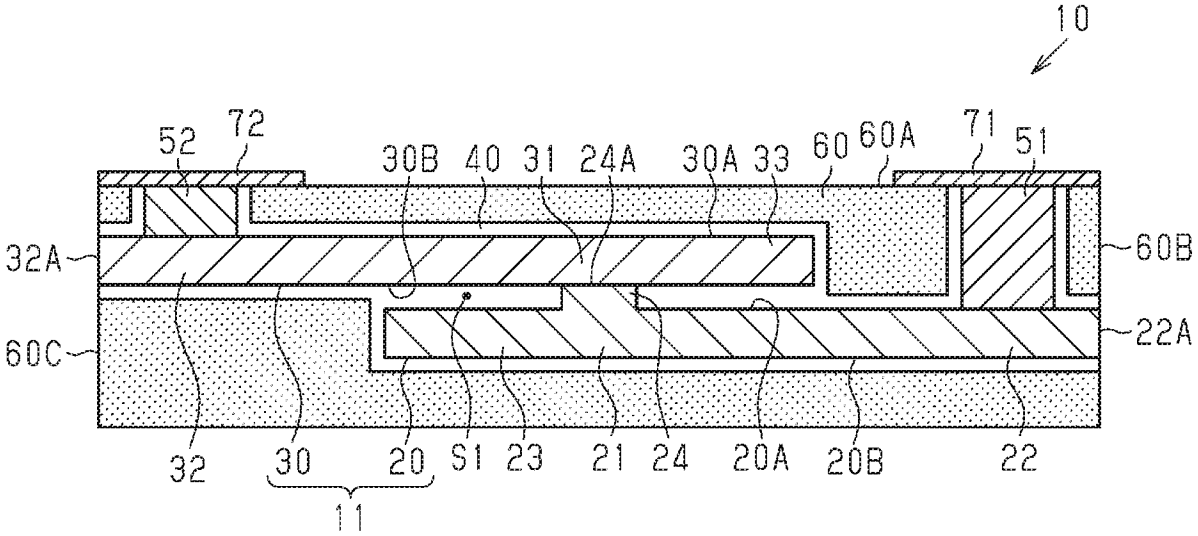

The structural body illustrated in FIG. 11A is cut along cutting lines, which are indicated by broken lines, with a dicing saw or the like. In the present example, the magnetic body 60, the insulation film 40, and the conductors 20 and 30 are cut along the cutting lines. As a result, the structural body illustrated in FIG. 11A is cut in each of the separate regions C1 and C2 to singulate an individual inductor 10 as illustrated in FIG. 11B. At this time, the end surface 60B of the magnetic body 60, the end surface of the insulation film 40, and the end surface 22A of the conductor 20, which are cut surfaces, are flush with each other. Also, the end surface 60C of the magnetic body 60, the end surface of the insulation film 40, and the end surface 32A of the conductor 30, which are cut surfaces, are flush with each other.

The manufacturing steps described above manufacture the inductor 10 illustrated in FIGS. 1 to 3. After singulation, the inductor 10 may be turned upside down and used or may be mounted at any angle.

The first embodiment has the advantages described below.

(1) The inductor 10 includes the conductor 20 spirally extending in a plane, the conductor 30 spirally extending in a plane and stacked on and joined to the conductor 20, the insulation film 40 covering the surfaces of the conductors 20 and 30, and the magnetic body 60 covering the surface of the insulation film 40 and embedding the conductors 20 and 30. The conductors 20 and 30 are embedded in the magnetic body 60. Thus, the magnetic body 60 fills the opening 20Y in the conductor 20 and the opening 30Y in the conductor 30. The magnetic body 60 is used as the core of the inductor 10. Since the magnetic body 60, which directly covers the surfaces of the conductors 20 and 30 via the insulation film 40, is used as the core, a gap is not formed between the conductors 20 and 30 (insulation film 40) and the magnetic body 60 (core). This allows for reduction in size and thickness of the inductor 10 as compared to a typical type of induction in which the winding is inevitably spaced apart from the core.

(2) The inner circumferential end 21 of the conductor 20 includes the projection 24 projecting toward the conductor 30 and located closer to the conductor 30 than other portions (in the present example, conductor portion 23 and outer circumferential end 22) of the conductor 20. The projection 24 is formed integrally with the other portions (conductor portion 23 and outer circumferential end 22) of the conductor 20. In the present example, a portion (inner circumferential end 21 including projection 24) of the conductor 20 and a portion (inner circumferential end 31) of the conductor 30 are used as joint portions, and the conductors 20 and 30 are joined by the joint portions. This improves the electric properties (e.g., electric resistance) of the helical coil 11 formed by the conductors 20 and 30 as compared to a case in which the joint portions are formed by members differing from the conductors 20 and 30.

(3) As compared to a case in which the projection 24 is formed by a member differing from the conductor 20, the height of the projection 24 is readily set to be low. This allows for formation of the coil 11 having a high density and further thins the inductor 10.

(4) The metal post 51, the upper surface of which is exposed through the magnetic body 60, is joined to the conductor 20. The metal post 52, the upper surface of which is exposed through the magnetic body 60, is joined to the conductor 30. As a result, the metal posts 51 and 52 connect the electrode connectors (i.e., outer circumferential ends 22 and 32) of the conductors 20 and 30 to the outside of the magnetic body 60. The electrodes 71 and 72 are formed on the upper surface 60A of the magnetic body 60 to cover the upper surfaces of the metal posts 51 and 52. Thus, the conductors 20 and 30 are readily electrically connected to the electrodes 71 and 72 via the metal posts 51 and 52. Electrical connection of the conductors 20 and 30 to the electrodes 71 and 72 is obtained more readily than, for example, a winding type having winding and an electrode that are electrically connected by welding. Additionally, the area of contact between the metal posts 51 and 52 and the electrodes 71 and 72 may be readily increased by adjusting the planar shapes of the metal posts 51 and 52.

Second Embodiment

A second embodiment will now be described with reference to FIGS. 12A to 12C. The second embodiment differs from the first embodiment in the method for manufacturing the inductor 10. Differences from the first embodiment will mainly be discussed below. The same reference characters are given to those members that are the same as the corresponding members illustrated in FIGS. 1 to 11B. Such members will not be described in detail.

Figures 12A, 12B, 12C:
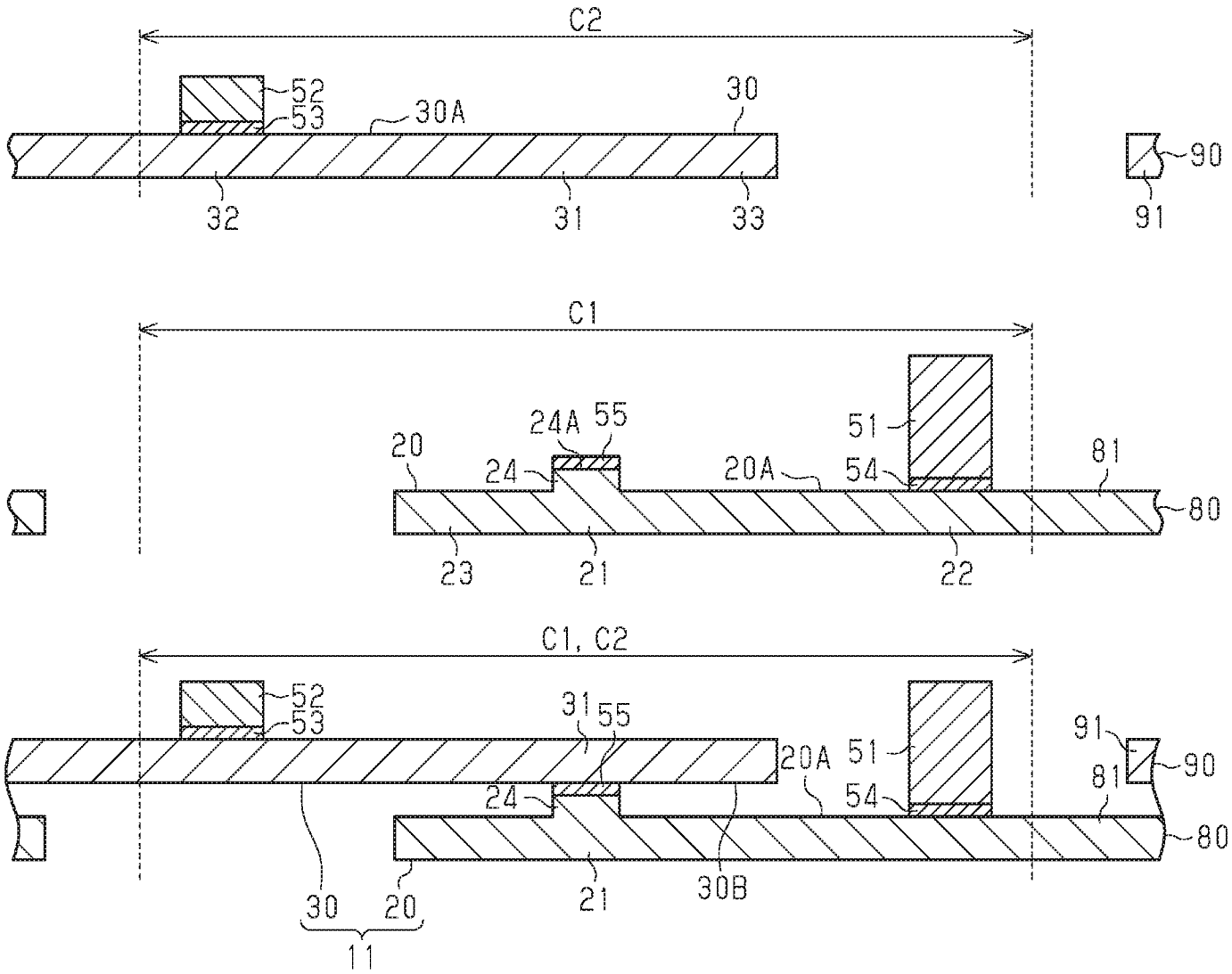
FIGS. 12A to 12C are schematic cross-sectional views illustrating a method for manufacturing a second embodiment of an inductor.

In the step illustrated in FIG. 12A, the same steps as illustrated in FIGS. 5A and 5B are performed so that the conductor 30 including the inner circumferential end 31, the outer circumferential end 32, and the conductor portion 33 spirally extending from the inner circumferential end 31 toward the outer circumferential end 32 is formed in each separate region C2. Then, a conductive bonding material 53 is formed on the upper surface 30A of the outer circumferential end 32. The bonding material 53 may be, for example, solder, a conductive paste such as a silver paste, or a brazing metal. The solder may be, for example, lead (Pd)-free solder (Sn—Ag base, Sn—Cu base, Sn—Ag—Cu base, or Sn—Zn (zinc)-Bi (bismuth) base). The bonding material 53 may be, for example, applied to the upper surface 30A of the outer circumferential end 32 using a dispenser or the like. The metal post 52 is arranged on the bonding material 53. The bonding material 53 is heated so that the bonding material 53 is joined to the conductor 30 and the metal post 52. As result, the metal post 52 is joined to the upper surface 30A of the outer circumferential end 32 of the conductor 30.

In the step illustrated in FIG. 12B, the same steps as illustrated in FIGS. 5A to 6C are performed so that the conductor 20 including the inner circumferential end 21, the outer circumferential end 22, and the conductor portion 23 spirally extending from the inner circumferential end 21 toward the outer circumferential end 22 is formed in each separate region C1. Then, a conductive bonding material 54 is formed on the upper surface 20A of the outer circumferential end 22. The material of the bonding material 54 may be, for example, the same as the material of the bonding material 53 (refer to FIG. 12A). The bonding material 54 may be, for example, applied to the upper surface 20A of the outer circumferential end 22 using a dispenser or the like. The metal post 51 is arranged on the bonding material 54. The bonding material 54 is heated so that the bonding material 54 is joined to the conductor 20 and the metal post 51. As a result, the metal post 51 is joined to the upper surface 20A of the outer circumferential end 22 of the conductor 20.

A conductive bonding material 55 is formed on the upper surface 24A of the projection 24 of the inner circumferential end 21 of the conductor 20. The material of the bonding material 55 may be, for example, the same as the material of the bonding material 53 (refer to FIG. 12A). The bonding material 55 may be, for example, applied to the upper surface 24A of the projection 24 using a dispenser or the like.

In the step illustrated in FIG. 12C, the conductor 20 is joined to the conductor 30. In the present example, the bonding material 55 joins the lower surface 30B of the inner circumferential end 31 of the conductor 30 to the upper surface 24A of the projection 24. In this step, the conductors 20 and 30 are positioned so that the lower surface 30B of the conductor 30 faces the upper surface 20A of the conductor 20, in the present example, so that the inner circumferential end 31 of the conductor 30 faces the projection 24 (inner circumferential end 21) of the conductor 20. Then, the lower surface 30B of the inner circumferential end 31 is brought into contact with the bonding material 55, which is applied to the upper surface 24A of the projection 24. The bonding material 55 is heated so that the bonding material 55 is bonded to the upper surface 24A of the projection 24 and the lower surface 30B of the inner circumferential end 31. As a result, the inner circumferential end 21 (projection 24) of the conductor 20 and the inner circumferential end 31 of the conductor 30 are joined by the bonding material 55.

Subsequently, the same steps illustrated in FIGS. 10A to 11B are performed to manufacture the inductor 10 of the second embodiment.

The second embodiment has the same advantages as the first embodiment.

Third Embodiment

A third embodiment will now be described with reference to FIGS. 13A to 14C. The third embodiment differs from the second embodiment in the method of manufacturing the inductor 10. Differences from the second embodiment will mainly be discussed below. The same reference characters are given to those members that are the same as the corresponding members illustrated in FIGS. 1 to 12C. Such members will not be described in detail.

Figure 13A:
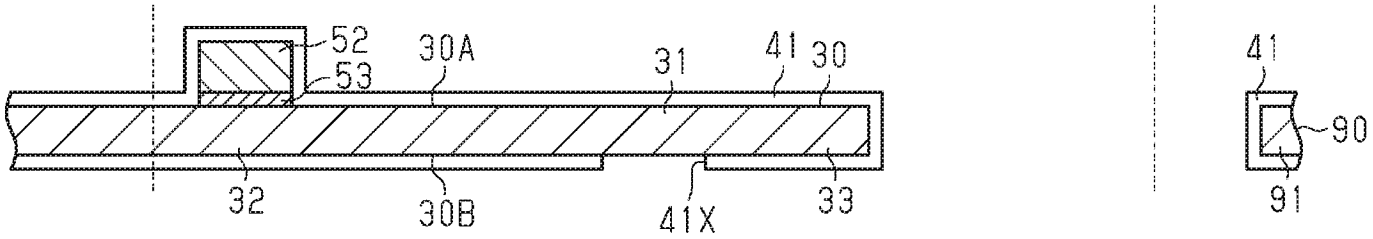
FIGS. 13A to 13C and 14A to 14C are schematic cross-sectional views illustrating a method for manufacturing a third embodiment of an inductor.

In the step illustrated in FIG. 13A, an insulation film 41 is formed to cover the entire surface of the structural body in which the metal post 52 is joined to the upper surface 30A of the outer circumferential end 32 of the conductor 30. The insulation film 41 may be formed, for example, in the same process as the insulation film 40 illustrated in FIG. 10A. The insulation film 41 is partially removed to form an opening 41X, which partially exposes the lower surface 30B of the conductor 30 of the inner circumferential end 31. The opening 41X may be formed, for example, by blasting or laser cutting. In the example illustrated in FIG. 13A, the bonding material 53 is used to join the metal post 52 to the upper surface 30A of the outer circumferential end 32. Instead, the metal post 52 may be joined to the upper surface 30A of the outer circumferential end 32 through diffusion bonding.

Figure 13B:
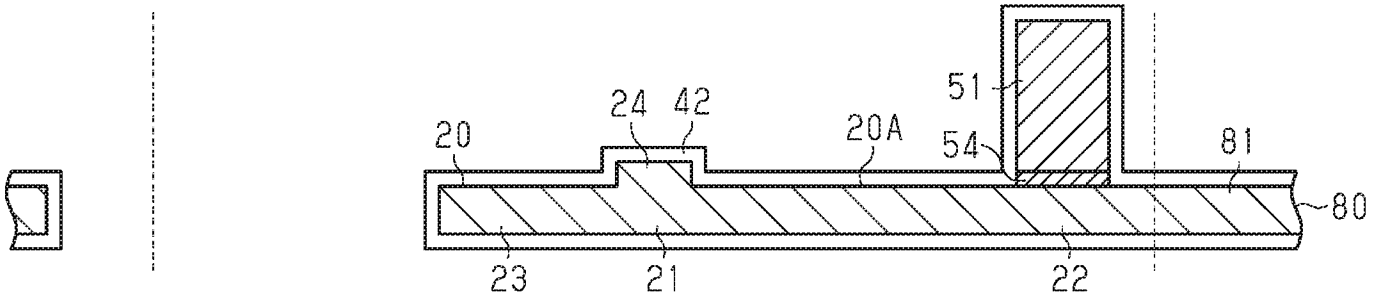

In the step illustrated in FIG. 13B, an insulation film 42 is formed to cover the entire surface of the structural body in which the metal post 51 is joined to the upper surface 20A of the outer circumferential end 22 of the conductor 20. The insulation film 42 may be formed, for example, in the same process as the insulation film 40 illustrated in FIG. 10A. In the example illustrated in FIG. 13B, the bonding material 54 is used to join the metal post 51 to the upper surface 20A of the outer circumferential end 22. Instead, the metal post 51 may be joined to the upper surface 20A of the outer circumferential end 22 through diffusion bonding.

Figure 13C:
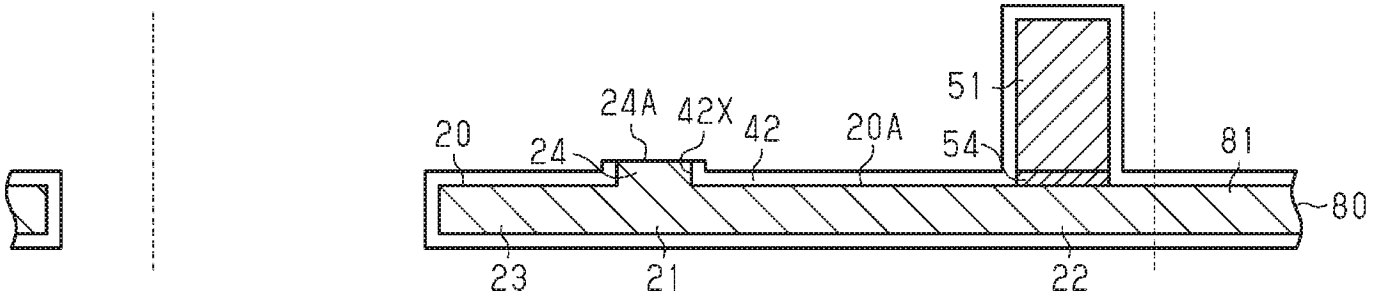

In the step illustrated in FIG. 13C, an opening 42X is formed in the insulation film 42 to expose the upper surface 24A of the projection 24 of the conductor 20. The opening 42X may be formed, for example, by blasting or laser cutting.

Figures 14A, 14B, 14C:
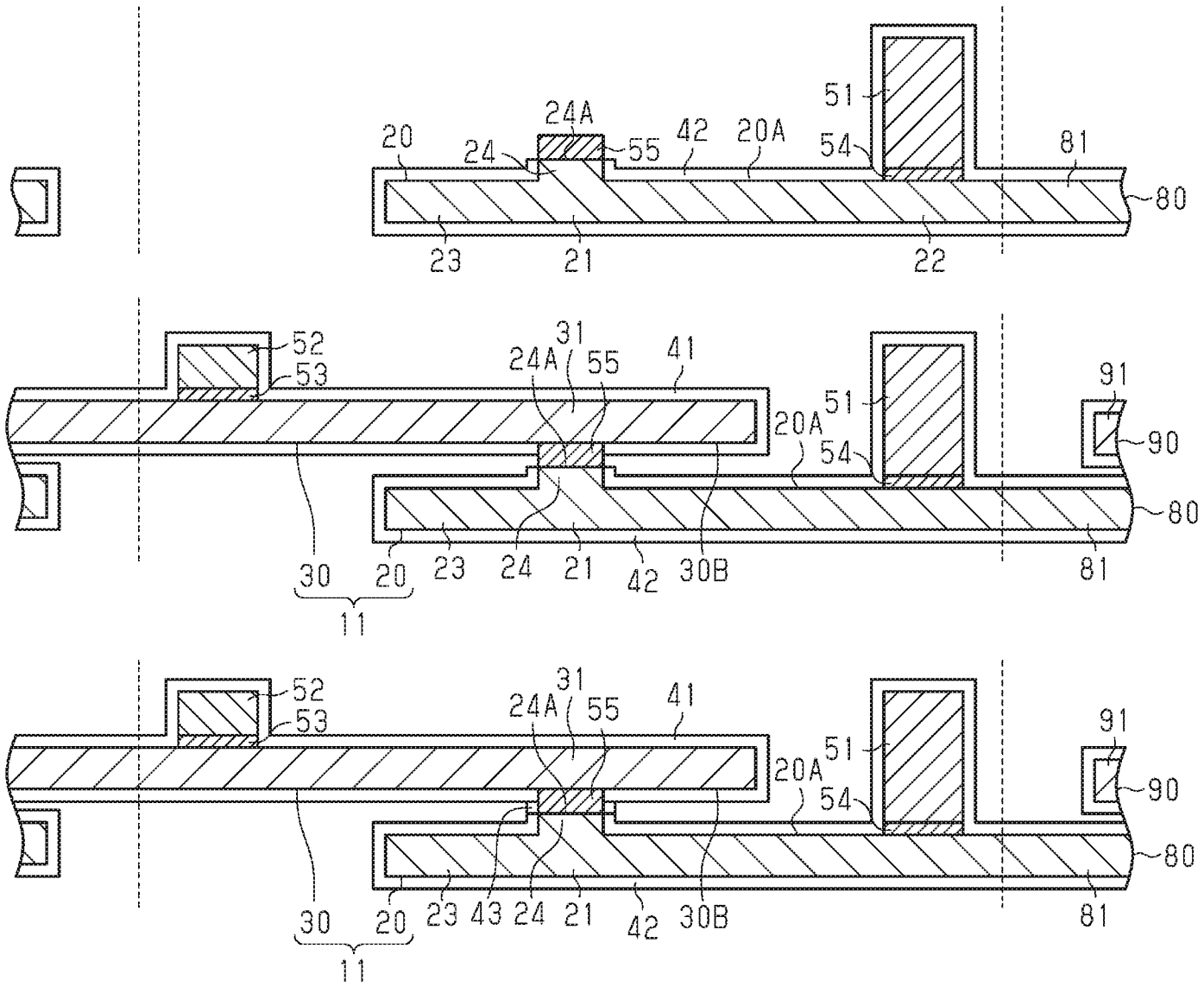

In the step illustrated in FIG. 14A, the conductive bonding material 55 is formed on the upper surface 24A of the projection 24 exposed through the insulation film 42.

In the step illustrated in FIG. 14B, the lower surface 30B of the inner circumferential end 31 exposed through the insulation film 41 is joined to the upper surface 24A of the projection 24 by the bonding material 55. In this step, the conductors 20 and 30 are positioned so that the lower surface 30B of the conductor 30 faces the upper surface 20A of the conductor 20, in the present example, so that the inner circumferential end 31 of the conductor 30 faces the projection 24 (inner circumferential end 21) of the conductor 20. Then, the lower surface 30B of the inner circumferential end 31 is brought into contact with the bonding material 55, which is applied to the upper surface 24A of the projection 24. The bonding material 55 is heated so that the bonding material 55 is bonded to the upper surface 24A of the projection 24 and the lower surface 30B of the inner circumferential end 31. As a result, the inner circumferential end 21 (projection 24) of the conductor 20 and the inner circumferential end 31 of the conductor 30 are joined by the bonding material 55.

In the step illustrated in FIG. 14C, an insulation film 43 is formed to cover the entire surface (here, side surface) of the bonding material 55 exposed through the insulation films 41 and 42. The insulation film 43 may be formed, for example, in the same process as the insulation film 40 illustrated in FIG. 10A.

In the manufacturing method described above, before the conductors 20 and 30 are joined, the insulation films 42 and 41 are formed to cover the surface of the respective conductors 20 and 30. The conductive bonding material 55 is used to join the conductors 20 and 30. When the bonding material 55 is used, the conductors 20 and 30 may be bonded at a lower heating temperature than when diffusion bonding is used. Thus, the insulation films 41 and 42, which are formed prior to joining of the conductors 20 and 30, receive a limited damage from the heating temperature during the joining.

Subsequently, the same steps as illustrated in FIGS. 10B to 11B are performed to manufacture the inductor 10 of the third embodiment.

The third embodiment has the same advantages as the first embodiment.

Fourth Embodiment

A fourth embodiment will now be described with reference to FIGS. 15A to 16C. The fourth embodiment differs from the first embodiment in the method of manufacturing the inductor 10. Differences from the first embodiment will mainly be discussed below. The same reference characters are given to those members that are the same as the corresponding members illustrated in FIGS. 1 to 14C. Such members will not be described in detail.

Figure 15A:
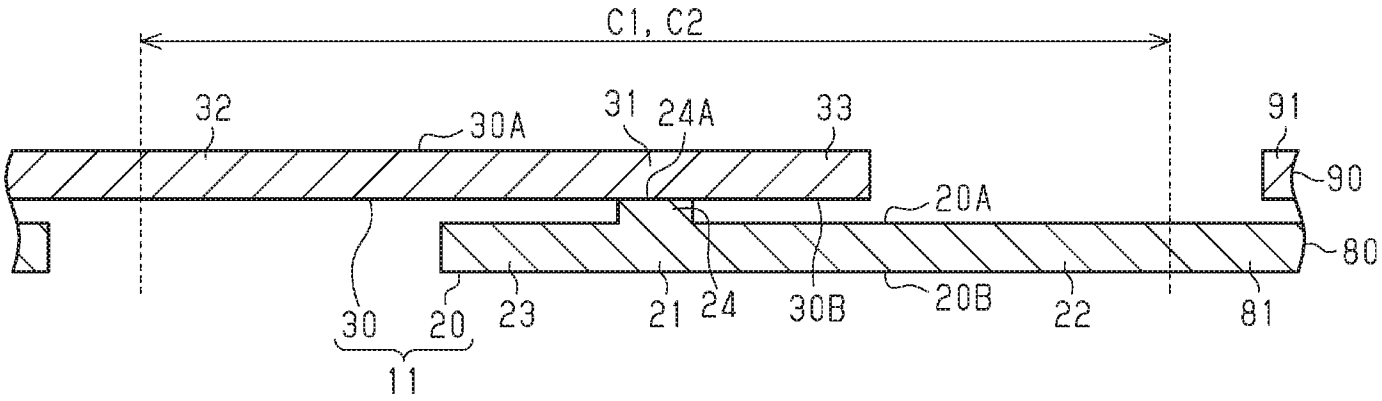
FIGS. 15A to 15C and 16A to 16C are schematic cross-sectional views illustrating a method for manufacturing a fourth embodiment of an inductor.

In the step illustrated in FIG. 15A, the same steps as illustrated in FIGS. 5A and 5B are performed so that the conductor 30 including the inner circumferential end 31, the outer circumferential end 32, and the conductor portion 33 spirally extending from the inner circumferential end 31 toward the outer circumferential end 32 is formed in each separate region C2. Additionally, the same steps as illustrated in FIGS. 5A to 6C are performed so that the conductor 20 including the inner circumferential end 21, the outer circumferential end 22, and the conductor portion 23 spirally extending from the inner circumferential end 21 toward the outer circumferential end 22 is formed in each separate region C1. Before the metal posts 51 and 52 are joined to the conductors 20 and 30, the conductor 20 is joined to the conductor 30. In the present example, when the lower surface 30B of the conductor 30 faces the upper surface 20A of the conductor 20 and the conductors 20 and 30 are vertically stacked, the inner circumferential end 31 of the conductor 30 is joined to the projection 24 of the conductor 20. The process of joining the conductors 20 and 30 may be diffusion bonding or may be bonding that uses a conductive bonding material.

Figure 15B:
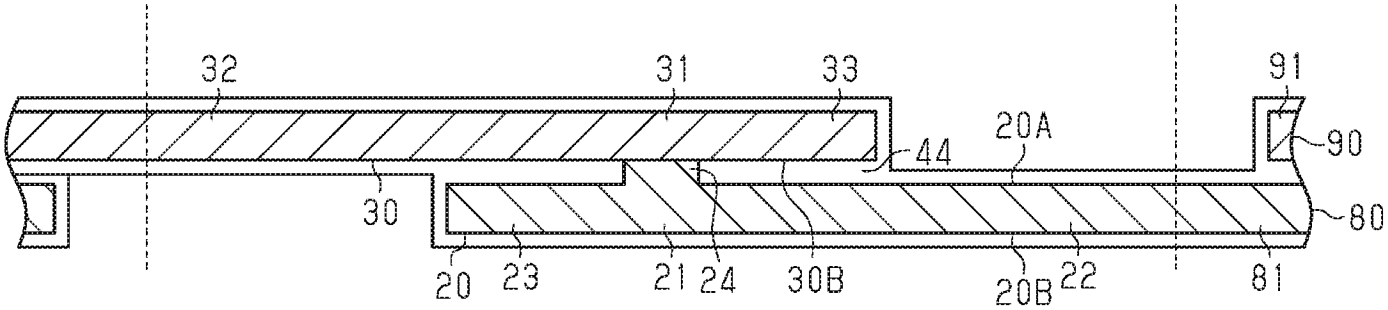

In the step illustrated in FIG. 15B, an insulation film 44 is formed to cover the entire surface of the conductors 20 and 30. The insulation film 44 covers, for example, the entire surface of the connecting portions 81 and 91. The insulation film 44 may be formed, for example, in the same process as the insulation film 40 illustrated in FIG. 10A.

Figure 15C:
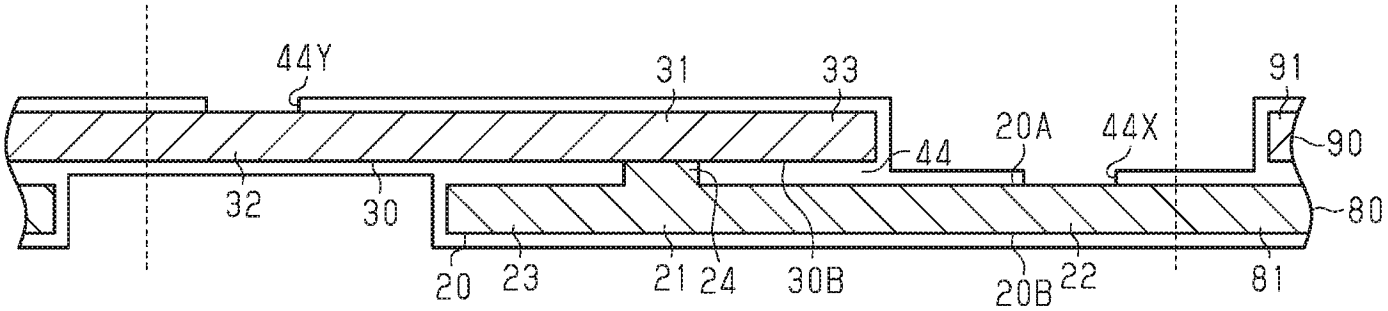

In the step illustrated in FIG. 15C, an opening 44X is formed in the insulation film 44 to expose the upper surface 20A of the outer circumferential end 22 of the conductor 20, and an opening 44Y is formed in the insulation film 44 to expose the upper surface 30A of the outer circumferential end 32 of the conductor 30. The openings 44X and 44Y may be formed, for example, by blasting or laser cutting.

Figure 16A:
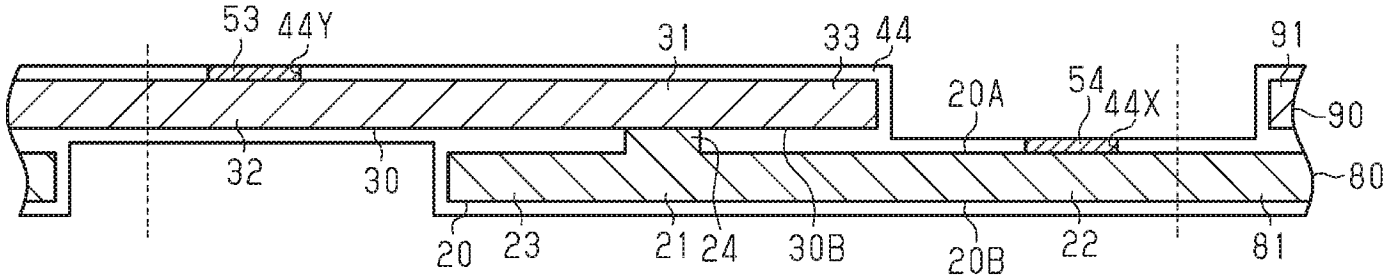

In the step illustrated in FIG. 16A, the conductive bonding material 54 is formed on the upper surface 20A of the outer circumferential end 22 exposed through the insulation film 44, and the conductive bonding material 53 is formed on the upper surface 30A of the outer circumferential end 32 exposed through the insulation film 44.

Figure 16B:
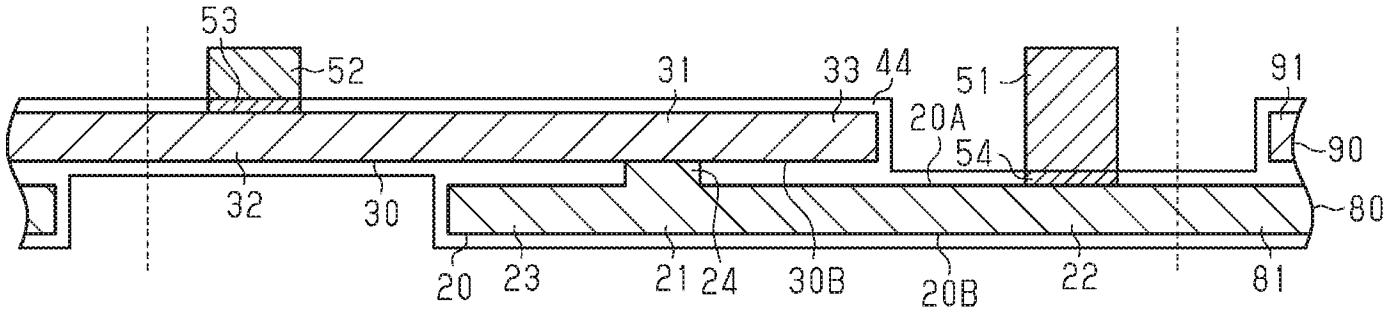

In the step illustrated in FIG. 16B, the metal post 51 is arranged on the bonding material 54, and the metal post 52 is arranged on the bonding material 53. The bonding materials 53 and 54 are heated so that the metal post 51 is joined to the upper surface 20A of the outer circumferential end 22 of the conductor 20 by the bonding material 54 and so that the metal post 52 is joined to the upper surface 30A of the outer circumferential end 32 of the conductor 30 by the bonding material 53.

Figure 16C:
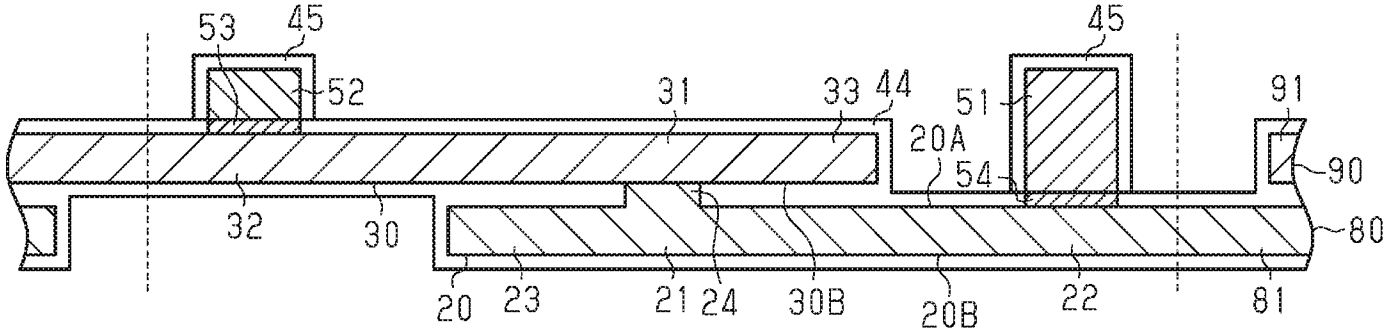

In the step illustrated in FIG. 16C, an insulation film 45 is formed to cover the metal posts 51 and 52 exposed through the insulation film 44 and the entire surface of the bonding materials 53 and 54. The insulation film 45 may be formed, for example, in the same process as the insulation film 40 illustrated in FIG. 10A.

In the manufacturing method described above, after the conductors 20 and 30 are joined, the metal posts 51 and 52 are respectively joined to the conductors 20 and 30. Additionally, before the metal posts 51 and 52 are joined to the conductors 20 and 30, the insulation film 44 is formed to cover the conductors 20 and 30. The conductive bonding materials 54 and 53 are used to join the metal posts 51 and 52 to the conductors 20 and 30. When the bonding materials 54 and 53 are used, the bonding may be performed at a lower heating temperature than when diffusion bonding is used. Thus, the insulation film 44, which is formed prior to joining of the metal posts 51 and 52 to the conductors 20 and 30, receives a limited damage from the heating temperature during the joining. In the present example, after the conductors 20 and 30 are joined, the insulation film 44 is formed. Instead, after the conductors 20 and 30 are joined, the metal posts 51 and 52 may first be joined to the conductors 20 and 30. In this case, after the metal posts 51 and 52 are joined to the conductors 20 and 30, the insulation film 40 (refer to FIG. 10A) may be formed to cover the surfaces of the conductors 20 and 30 and the surfaces of the metal posts 51 and 52 in the same manner as in the step illustrated in FIG. 10A.

Subsequently, the same steps as illustrated in FIGS. 10B to 11B are performed to manufacture the inductor 10 of the fourth embodiment.

The fourth embodiment has the same advantages as the first embodiment.

Fifth Embodiment

A fifth embodiment will now be described with reference to FIGS. 17A to 19B. The fifth embodiment differs from the first embodiment in the method of manufacturing the inductor 10. Differences from the first embodiment will mainly be discussed below. The same reference characters are given to those members that are the same as the corresponding members illustrated in FIGS. 1 to 16C. Such members will not be described in detail.

Figure 17A:
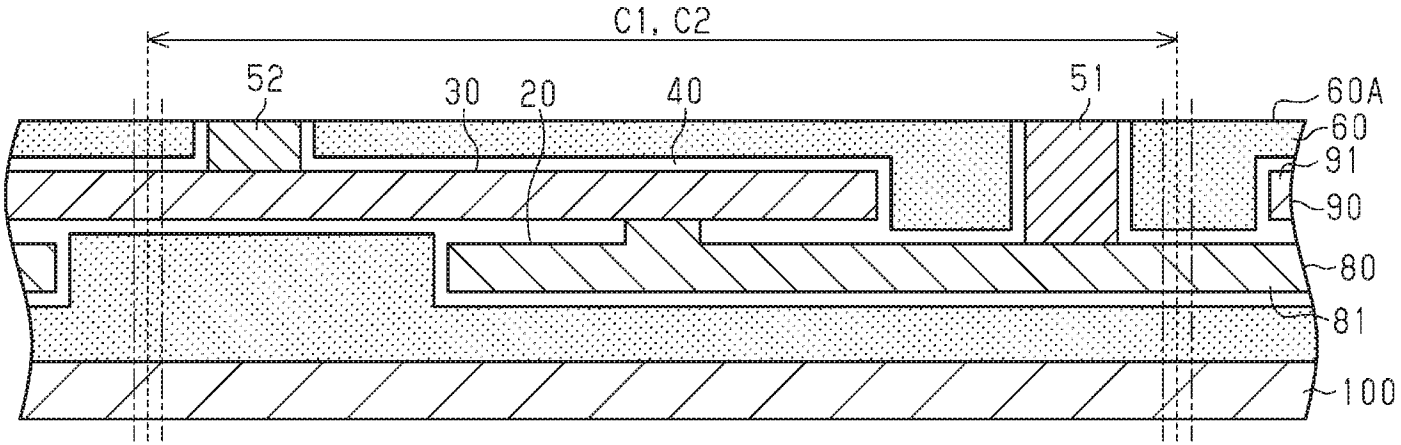
FIGS. 17A and 17B are schematic cross-sectional views illustrating a method for manufacturing a fifth embodiment of an inductor.

In the step illustrated in FIG. 17A, the steps illustrated in FIGS. 5A to 10C are performed to manufacture the structural body illustrated in FIG. 17A.

Figure 17B:
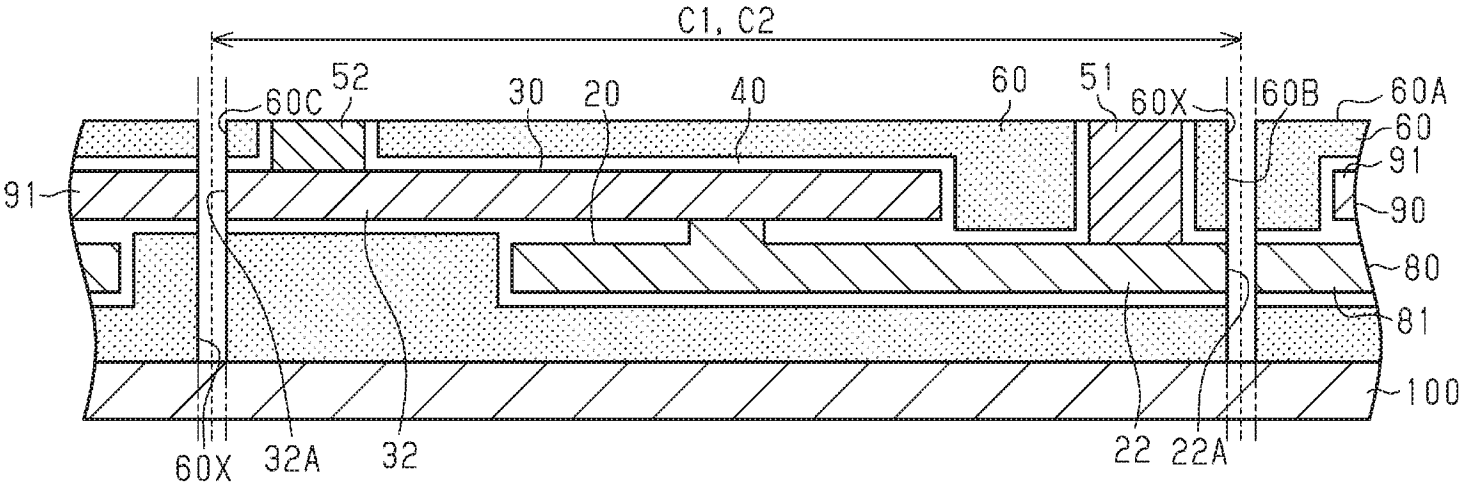

In the step illustrated in FIG. 17B, the structural body illustrated in FIG. 17A is cut along a cutting region, which is indicated by double-dashed lines, with a dicing saw or the like to form grooves 60X. In the cutting region, which is indicated by double-dashed lines, the grooves 60X cut the magnetic body 60, the insulation film 40, and the conductors 20 and 30. The grooves 60X separate the outer circumferential end 22 of the conductor 20 from the connecting portion 81 and the outer circumferential end 32 of the conductor 30 from the connecting portions 91. As a result, in each of the separate regions C1 and C2, the end surface 60B of the magnetic body 60 and the end surface 22A of the outer circumferential end 22 of the conductor 20 are exposed to the exterior. Additionally, in each of the separate regions C1 and C2, the end surface 60C of the magnetic body 60 and the end surface 32A of the outer circumferential end 32 of the conductor 30 are exposed to the exterior.

Figure 18A:
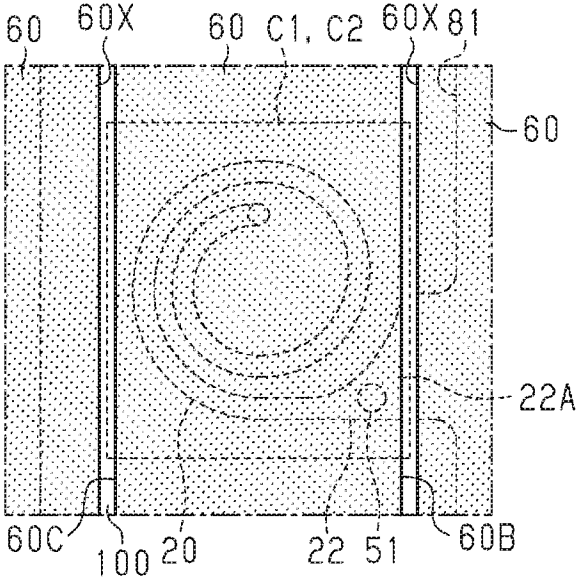
FIG. 18A is an enlarged plan view of the structural body illustrated in FIG. 17B.

As illustrated in FIG. 18A, the grooves 60X extend in one direction (in FIG. 18A, vertical direction). In other words, in the step illustrated in FIG. 18A, the separate regions C1 and C2 are not yet cut in a direction (in FIG. 18A, sideward direction) orthogonal to the direction in which the grooves 60X extend in a plan view. This step is performed when the structural body including the magnetic body 60 is fixed to the support substrate 100. Thus, the cut structural body remains fixed to the support substrate 100. For the sake of simplicity, FIG. 18A does not illustrate the conductor 30, the metal post 52, and the insulation film 40.

Figure 18B:
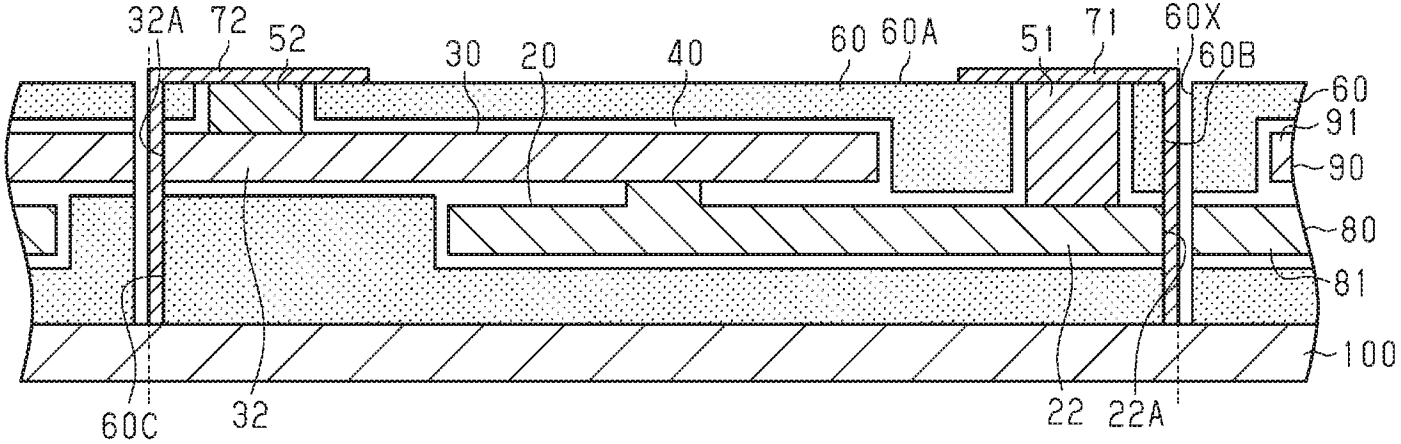
FIG. 18B is a schematic cross-sectional view illustrating the method of manufacturing the inductor following the step illustrated in FIG. 17B.

In the step illustrated in FIG. 18B, the electrode 71 is formed to continuously cover the upper surface 60A and the end surface 60B of the magnetic body 60, and the electrode 72 is formed to continuously cover the upper surface 60A and the end surface 60C of the magnetic body 60. The electrode 71 is formed on the upper surface 60A of the magnetic body 60 to cover the entire upper surface (entire end surface) of the metal post 51 and is formed on the end surface 60B of the magnetic body 60 to cover the entire end surface 22A of the outer circumferential end 22 of the conductor 20 and the entire end surface 60B of the magnetic body 60. The electrode 72 is formed on the upper surface 60A of the magnetic body 60 to cover the entire upper surface (entire end surface) of the metal post 52 and is formed on the end surface 60C of the magnetic body 60 to cover the entire end surface 32A of the outer circumferential end 32 of the conductor 30 and the entire end surface 60C of the magnetic body 60. The electrodes 71 and 72 may be formed, for example, by sputtering or vapor deposition.

Figure 19A:
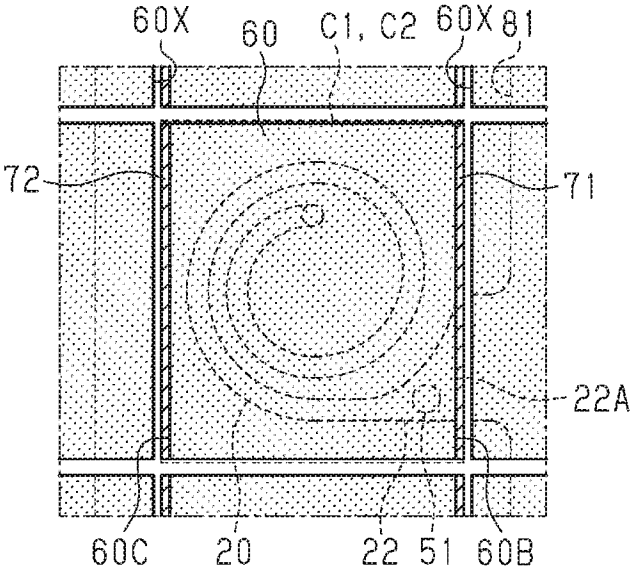
FIG. 19A is an enlarged plan view illustrating the method for manufacturing the inductor following the step illustrated in FIG. 18B.
Figure 19B:
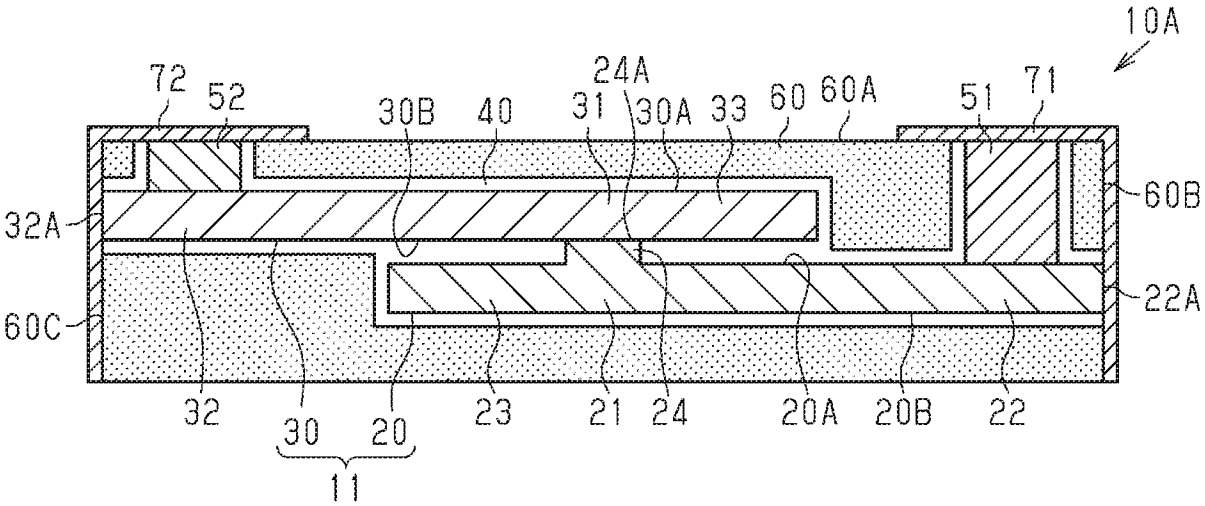
FIG. 19B is a schematic cross-sectional view of the structural body (inductor) illustrated in FIG. 19A.

In the step illustrated in FIG. 19A, the structural body illustrated in FIG. 18B is cut along the separate regions C1 and C2 with a dicing saw or the like. In the present example, the structural body illustrated in FIG. 18B is cut along the separate regions C1 and C2 in a direction orthogonal to the grooves 60X in a plan view. As a result, the structural body illustrated in FIG. 18B is cut in each of the separate regions C1 and C2 to singulate an individual inductor 10A as illustrated in FIG. 19B.

The manufacturing steps described above manufacture the inductor 10 of the fifth embodiment.

The fifth embodiment has the advantage described below in addition to advantages (1) to (4) of the first embodiment.

(5) The electrode 71 covers the entire upper surface of the metal post 51 and the entire end surface 22A of the outer circumferential end 22 of the conductor 20. The electrode 72 covers the entire upper surface of the metal post 52 and the entire end surface 32A of the outer circumferential end 32 of the conductor 30. This increases the area of contact between the electrodes 71 and 72 and an end of the helical coil 11.

Sixth Embodiment

A sixth embodiment will now be described with reference to FIGS. 20A to 22B. The sixth embodiment differs from the first embodiment in the method of manufacturing the inductor 10. Differences from the first embodiment will mainly be discussed below. The same reference characters are given to those members that are the same as the corresponding members illustrated in FIGS. 1 to 19B. Such members will not be described in detail.

Figure 20A:
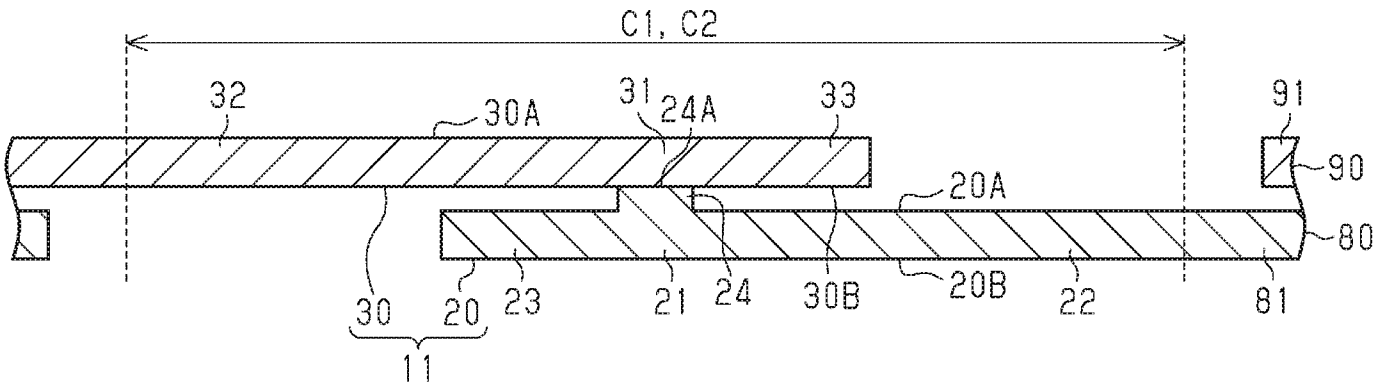
FIGS. 20A to 20C, 21A, 21B, and 22A are schematic cross-sectional views illustrating a method for manufacturing a sixth embodiment of an inductor.

In the step illustrated in FIG. 20A, the same steps as illustrated in FIGS. 5A and 5B are performed so that the conductor 30 including the inner circumferential end 31, the outer circumferential end 32, and the conductor portion 33 spirally extending from the inner circumferential end 31 toward the outer circumferential end 32 is formed in each separate region C2. Additionally, the same steps as illustrated in FIGS. 5A to 6C are performed so that the conductor 20 including the inner circumferential end 21, the outer circumferential end 22, and the conductor portion 23 spirally extending from the inner circumferential end 21 toward the outer circumferential end 22 is formed in each separate region C1. The conductor 30 is joined to the conductor 20. In the present example, when the lower surface 30B of the conductor 30 faces the upper surface 20A of the conductor 20 and the conductors 20 and 30 are vertically stacked, the inner circumferential end 31 of the conductor 30 is joined to the projection 24 of the conductor 20. The process of joining the conductors 20 and 30 may be diffusion bonding or may be bonding that uses a conductive bonding material.

Figure 20B:
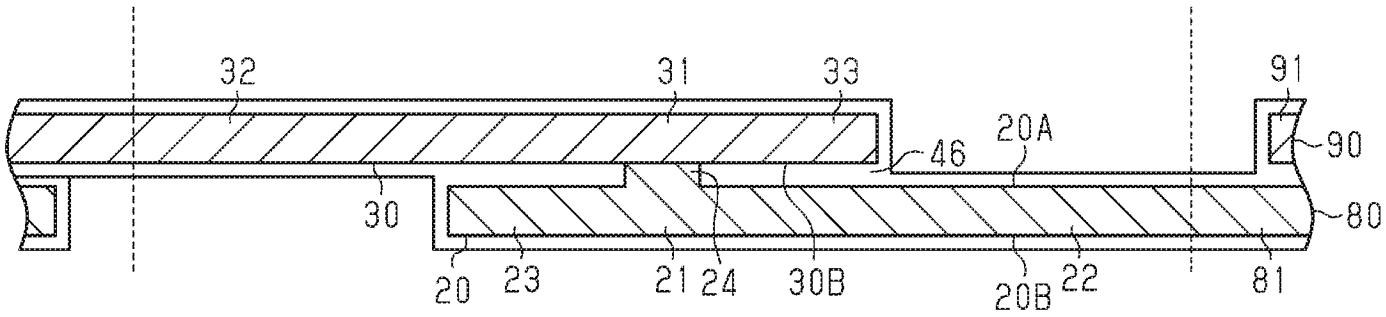

In the step illustrated in FIG. 20B, an insulation film 46 is formed to cover the entire surface of the conductors 20 and 30. The insulation film 46 may be formed, for example, in the same process as the insulation film 40 illustrated in FIG. 10A.

Figure 20C:
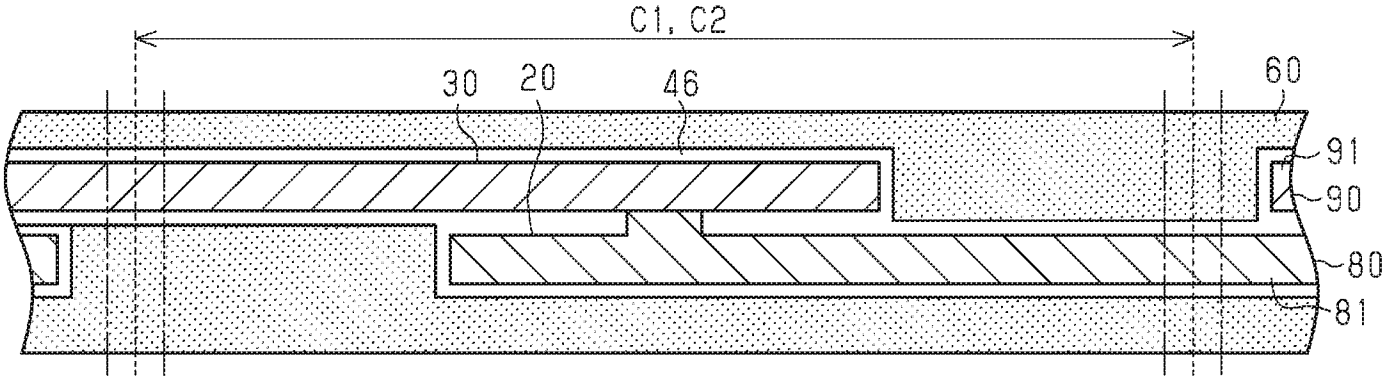

In the step illustrated in FIG. 20C, in the same manner as the step illustrated in FIG. 10B, the magnetic body 60 is formed to entirely encapsulate the conductors 20 and 30 and the insulation film 46 formed in the separate regions C1 and C2. In the present example, the magnetic body 60 also encapsulates the connecting portions 81 located between adjacent separate regions C1 and the connecting portions 91 located between adjacent separate regions C2.

Figure 21A:
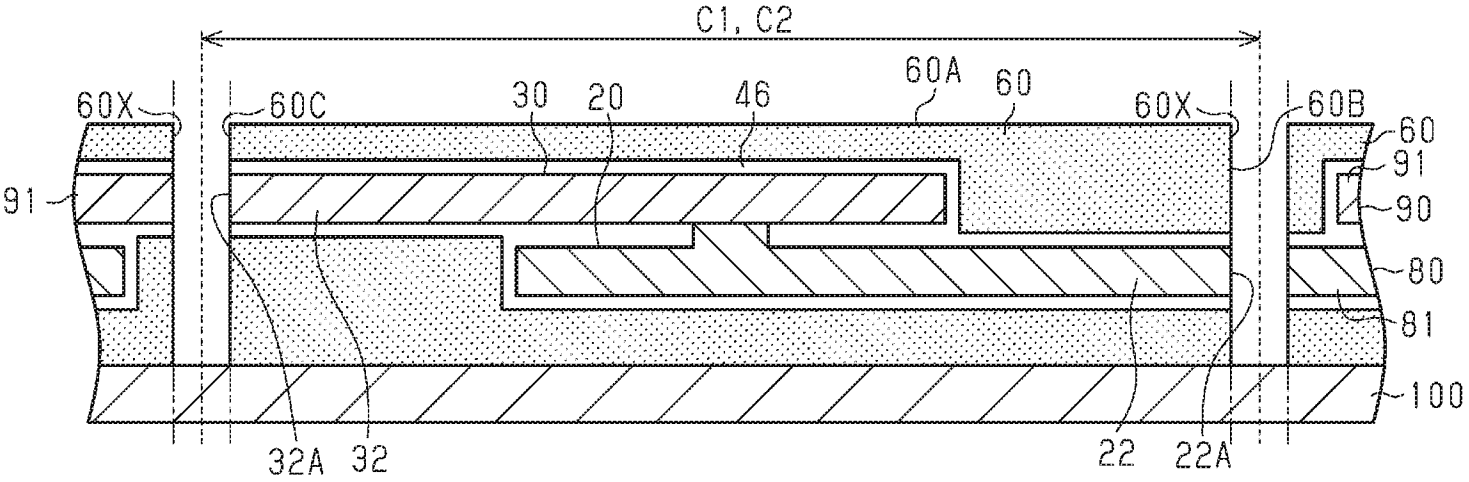

In the step illustrated in FIG. 21A, the structural body illustrated in FIG. 20C is fixed to the upper surface of the support substrate 100. In the same manner as the step illustrated in FIG. 17B, the structural body illustrated in FIG. 20C is cut along a cutting region, which is indicated by double-dashed lines, with a dicing saw or the like to form grooves 60X. The grooves 60X separate the outer circumferential end 22 of the conductor 20 from the connecting portion 81 and the outer circumferential end 32 of the conductor 30 from the connecting portions 91. As a result, in each of the separate regions C1 and C2, the end surface 60B of the magnetic body 60 and the end surface 22A of the outer circumferential end 22 of the conductor 20 are exposed to the exterior. Additionally, in each of the separate regions C1 and C2, the end surface 60C of the magnetic body 60 and the end surface 32A of the outer circumferential end 32 of the conductor 30 are exposed to the exterior.

Figure 21B:
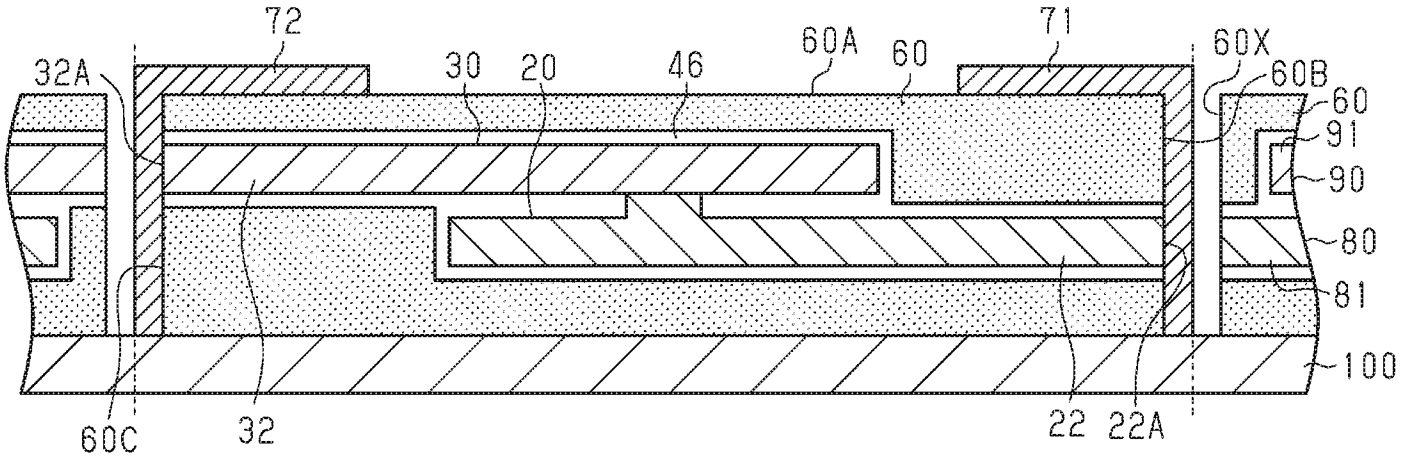

In the step illustrated in FIG. 21B, the electrode 71 is formed on the upper surface 60A and the end surface 60B of the magnetic body 60, and the electrode 72 is formed on the upper surface 60A and the end surface 60C of the magnetic body 60. The electrode 71 continuously covers the upper surface 60A and the end surface 60B of the magnetic body 60 and covers the entire end surface 22A of the outer circumferential end 22 of the conductor 20 and the entire end surface 60B of the magnetic body 60. The electrode 72 continuously covers the upper surface 60A and the end surface 60C of the magnetic body 60 and covers the entire end surface 32A of the outer circumferential end 32 of the conductor 30 and the entire end surface 60C of the magnetic body 60. The electrodes 71 and 72 may be formed, for example, by sputtering or vapor deposition. The thickness of each of the electrodes 71 and 72 may be, for example, approximately 35 to 50 μm. Even when the metal posts 51 and 52 illustrated in FIG. 1 are omitted, increases in the thickness of the electrodes 71 and 72 allow the electric properties (e.g., electric resistance) to be the same as those of when the metal posts 51 and 52 are formed.

Figure 22A:
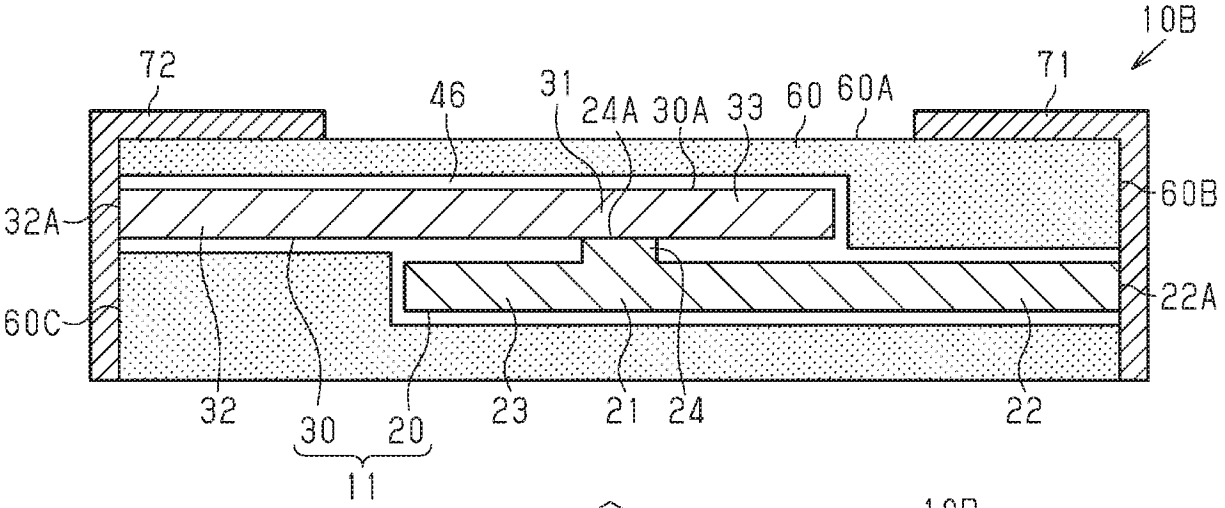
Figure 22B:
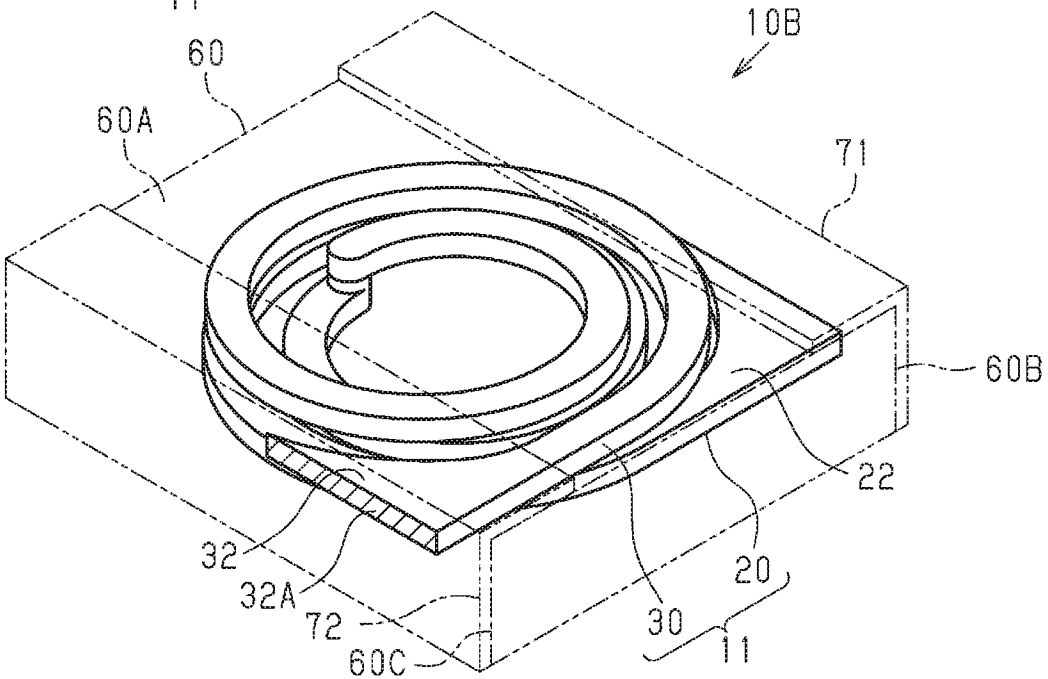
FIG. 22B is a schematic perspective view of the structural body (inductor) illustrated in FIG. 22A.

In the same manner as the step illustrated in FIG. 19A, the structural body illustrated in FIG. 21B is cut along the separate regions C1 and C2. As a result, an individual inductor 10B is singulated as illustrated in FIGS. 22A and 22B. The manufacturing steps described above manufacture the inductor 10B of the sixth embodiment. At this time, in the inductor 10B, the electrode 71 is electrically connected to the end surface 22A of the outer circumferential end 22 of the conductor 20, and the electrode 72 is electrically connected to the end surface 32A of the outer circumferential end 32 of the conductor 30.

In the inductor 10B, the metal posts 51 and 52 (refer to FIG. 1) are omitted from the inductor 10 of the first embodiment. Thus, the inductor 10B is thinned corresponding to the height of the metal posts 51 and 52.

The sixth embodiment has the same advantages as the first embodiment.

It should be apparent to those skilled in the art that the foregoing embodiments may be implemented in many other specific forms without departing from the scope of this disclosure. Particularly, it should be understood that the foregoing embodiments may be implemented in the following forms.

In the above-described embodiments, a plating film may be formed on surfaces of the conductors 20 and 30.

Figure 23A:
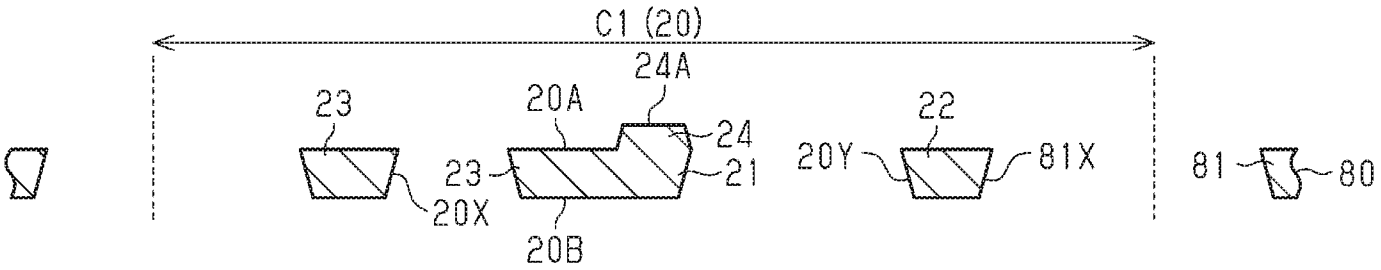
FIGS. 23A and 23B are schematic cross-sectional views illustrating a method of manufacturing an modified example of an inductor.

For example, as illustrated in FIG. 23A, the same steps as illustrated in FIGS. 5A to 6C are performed so that the conductor 20 including the inner circumferential end 21, the outer circumferential end 22, and the conductor portion 23 spirally extending from the inner circumferential end 21 toward the outer circumferential end 22 is formed in each separate region C1.

Figure 23B:
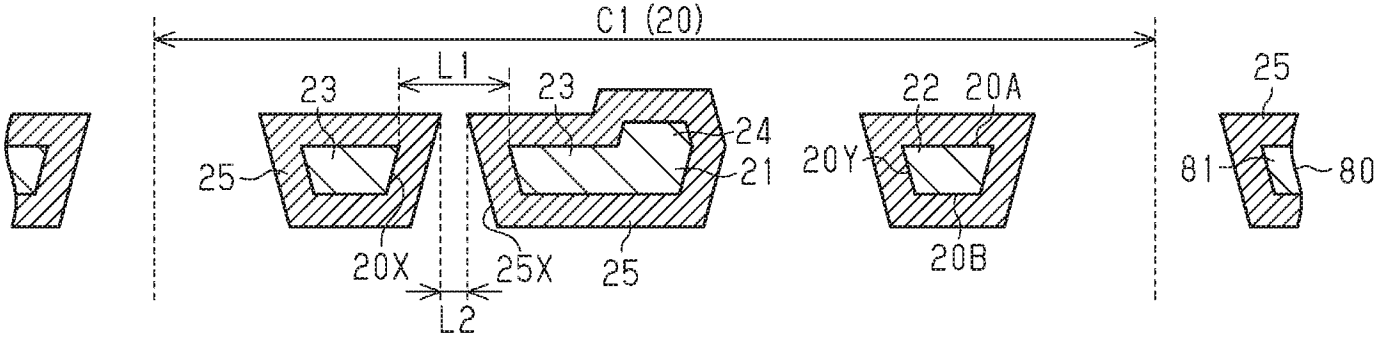
Figure 23C:
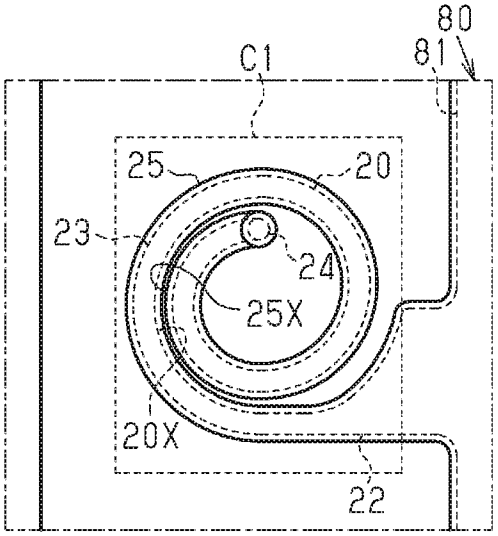
FIG. 23C is an enlarged plan view of the structural body illustrated in FIG. 23B.

As illustrated in FIGS. 23B and 23C, a plating film 25 is formed to cover the entire surface of the conductor 20. The material of the plating film 25 may be, for example, Cu or a Cu alloy. The thickness (film thickness) of the plating film 25 may be, for example, approximately 20 to 40 μm. Formation of the plating film 25 narrows a gap (slit 20X) between adjacent spiral parts of the conductor portion 23. For example, when the slit 20X has a width L1 of 90 μm and the plating film 25 has a thickness of 40 μm, a slit 25X between adjacent ones of the plating films 25 may have a width L2 of 10 μm. This allows for formation of the coil having a high density and miniaturizes the inductor 10.

Figure 24:
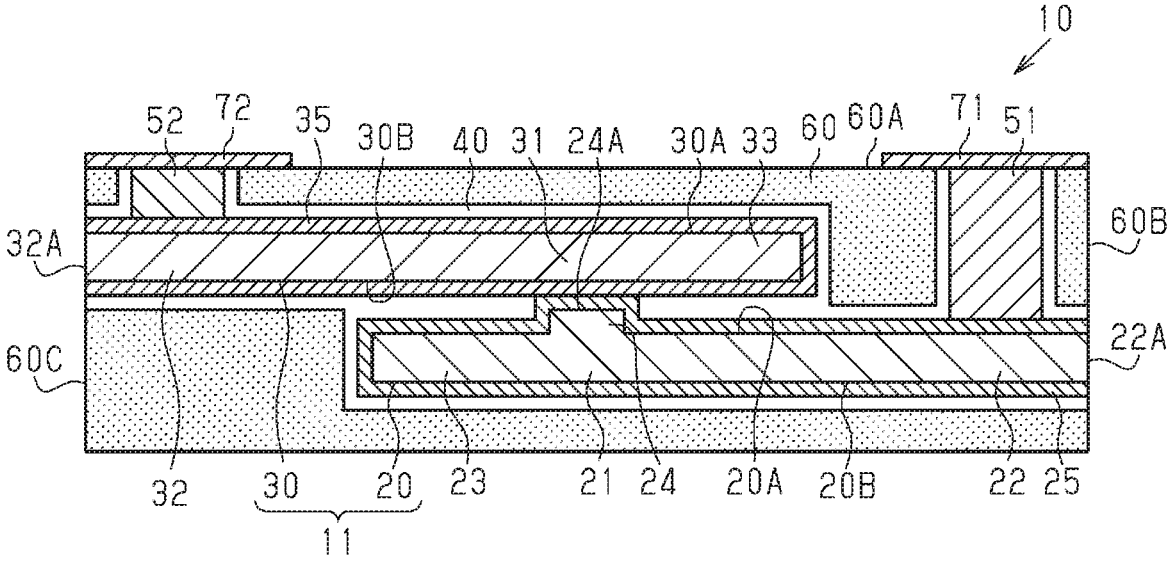
FIG. 24 is a schematic cross-sectional view illustrating the inductor of the modified example.

As illustrated in FIG. 24, a plating film 35 covering the entire surface of the conductor 30 may be formed in the same manner as the plating film 25, which covers the conductor 20. For example, the metal post 51 is joined to the upper surface of the plating film 25, and the metal post 52 is joined to the upper surface of the plating film 35. The insulation film 40 covers surfaces of the plating films 25 and 35 and surfaces of the metal posts 51 and 52. With this structure, formation of the plating films 25 and 35 increases the cross-sectional area of the conductor of the helical coil 11. This reduces direct-current resistance in the inductor 10 and improves the properties of the inductor 10.

In the modified example illustrated in FIG. 24, the metal posts 51 and 52 are respectively formed on the plating films 25 and 35. However, there is no limitation to such a configuration. For example, after the metal post 51 is joined to the upper surface 20A of the conductor 20, the plating film 25 may be formed to entirely cover the surfaces of the conductor 20 and the metal post 51. In the same manner, after the metal post 52 is joined to the upper surface 30A of the conductor 30, the plating film 35 may be formed to entirely cover the surfaces of the conductor 30 and the metal post 52.

In the embodiments, the projection 24 is formed on only the inner circumferential end 21 of the conductor 20. Additionally, a projection may be formed on the inner circumferential end 31 of the conductor 30.

Figure 25:
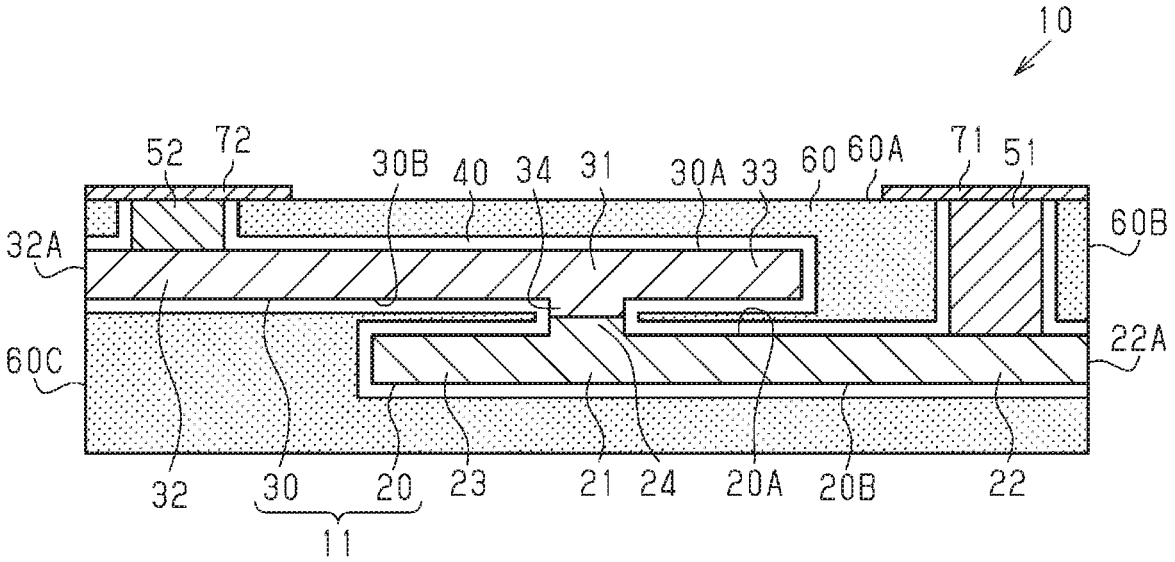
FIG. 25 is a schematic cross-sectional view illustrating another modified example of an inductor.

For example, as illustrated in FIG. 25, the projection 24 may be formed on the inner circumferential end 21 of the conductor 20, and a projection 34 may be formed on the inner circumferential end 31 of the conductor 30. Alternatively, when the conductors 20 and 30 are located vertically adjacent to each other, the projection 34 may be formed on only the inner circumferential end 31 of the conductor 30, which is located at the upper side. The projection 34 may be formed in the same manner as the projection 24.

In the embodiments, the number of turns of the conductors 20 and 30 is not particularly limited.

In the embodiments, the conductors 20 and 30 are circularly spiral. Instead, for example, the conductors 20 and 30 may be, for example, rectangularly spiral.

In the embodiments, the two conductors 20 and 30 spirally extend in respective planes and are connected in series to form the helical coil 11. However, the number of conductors that are stacked is not particularly limited. For example, three or more conductors may spirally extend in respective planes and be connected in series to form a helical coil.

In the above embodiments, a method for manufacturing a batch of inductors is embodied. Instead, a method for manufacturing a single inductor (one inductor) may be embodied.

The embodiments and the modified examples may be combined as long as the combined modifications remain technically consistent with each other.

CLAUSES

This disclosure further encompasses the following embodiments.

1. A method for manufacturing an inductor, the method including:
   patterning a first metal plate to form a first conductor that is spiral in a plane;
   patterning a second metal plate to form a second conductor that is spiral in a plane;
   forming a helical coil by stacking the second conductor on the first conductor and joining and connecting the second conductor to the first conductor;
   forming an insulation film that covers a surface of the first conductor and a surface of the second conductor; and
   forming a magnetic body that covers a surface of the insulation film and embeds the first conductor and the second conductor.
2. The method according to clause 1, further including: before forming the helical coil,
   form a projection in the first conductor, wherein the projection is formed by thinning a portion of the first conductor except the projection so that the projection projects from the thinned portion of the first conductor toward the second conductor, and the projection is joined to the second conductor.

All examples and conditional language recited herein are intended for pedagogical purposes to aid the reader in understanding the principles of the invention and the concepts contributed by the inventors to furthering the art, and are to be construed as being without limitation to such specifically recited examples and conditions, nor does the organization of such examples in the specification relate to an illustration of the superiority and inferiority of the invention. Although embodiments have been described in detail, it should be understood that various changes, substitutions, and alterations could be made hereto without departing from the scope of this disclosure.

The invention claimed is:

1. An inductor comprising:
a first conductor spirally extending in a plane;
a second conductor spirally extending in a plane, wherein the second conductor is stacked on and joined to the first conductor;
an insulation film covering a surface of the first conductor and a surface of the second conductor; and
a magnetic body covering a surface of the insulation film and embedding the first conductor and the second conductor, wherein the first conductor and the second conductor are connected to form a helical coil, wherein the first conductor includes an inner circumferential end, an outer circumferential end, and a conductor portion spirally extending from the inner circumferential end toward the outer circumferential end, wherein the inner circumferential end includes a projection projecting toward the second conductor and joined to the second conductor, wherein the projection is tapered to have a width that gradually decreases in a direction in which the projection projects toward the second conductor, and wherein the inner circumferential end except the projection, the outer circumferential end, and the conductor portion are reversely tapered to have a width that gradually increases in the direction in which the projection projects toward the second conductor.

2. The inductor according to claim 1, wherein the projection is joined to the second conductor by diffusion bonding or a conductive bonding material.

3. The inductor according to claim 1, wherein the first conductor includes a first surface facing the second conductor, wherein the projection is formed on the first surface, and a second surface opposite to the first surface, and a planar shape of the first surface has a greater dimension than a planar shape of the second surface.

4. The inductor according to claim 1, further comprising:

a first plating film formed on a surface of the first conductor; and a second plating film formed on a surface of the second conductor, wherein the insulation film covers a surface of the first plating film and a surface of the second plating film.

5. The inductor according to claim 1, further comprising:

a first metal post joined to the first conductor and including an end surface exposed through the magnetic body;

a second metal post joined to the second conductor and including an end surface exposed through the magnetic body;

a first electrode formed on a surface of the magnetic body to entirely cover the end surface of the first metal post; and a second electrode formed on a surface of the magnetic body to entirely cover the end surface of the second metal post.

6. The inductor according to claim 5, further comprising:

a first conductive bonding material that bonds the first metal post to the first conductor; and a second conductive bonding material that bonds the second metal post to the second conductor.

7. The inductor according to claim 1, wherein the first conductor includes an outer circumferential end having an end surface exposed in a first end surface of the magnetic body, the second conductor includes an outer circumferential end having an end surface exposed in a second end surface of the magnetic body, and the inductor further comprises:

a first electrode formed on the first end surface of the magnetic body to cover the end surface of the outer circumferential end of the first conductor; and a second electrode formed on the second end surface of the magnetic body to cover the end surface of the outer circumferential end of the second conductor.

8. The inductor according to claim 7, further comprising:

a first metal post joined to the first conductor and including an end surface exposed through the magnetic body; and a second metal post joined to the second conductor and including an end surface exposed through the magnetic body, wherein the first electrode continuously covers the first end surface of the magnetic body and a surface of the magnetic body that exposes the end surface of the first metal post and the end surface of the second metal post, the first electrode is in contact with both of the end surface of the outer circumferential end of the first conductor and the end surface of the first metal post, the second electrode continuously covers the second end surface of the magnetic body and the surface of the magnetic body that exposes the end surface of the first metal post and the end surface of the second metal post, and the second electrode is in contact with both of the end surface of the outer circumferential end of the second conductor and the end surface of the second metal post.

9. The inductor according to claim 1, wherein the first conductor has a rectangular sideward cross section, and the second conductor has a rectangular sideward cross section.

* * * * *